US009246228B2

(12) United States Patent
Lee et al.

(10) Patent No.: US 9,246,228 B2
(45) Date of Patent: Jan. 26, 2016

(54) MULTIBAND COMPOSITE RIGHT AND LEFT HANDED (CRLH) SLOT ANTENNA

(75) Inventors: Cheng-Jung Lee, San Diego, CA (US); Ajay Gummalla, San Diego, CA (US); Maha Achour, Encinitas, CA (US)

(73) Assignee: Tyco Electronics Services GmbH (CH)

( * ) Notice: Subject to any disclaimer, the term of this patent is extended or adjusted under 35 U.S.C. 154(b) by 784 days.

(21) Appl. No.: 12/723,540

(22) Filed: Mar. 12, 2010

(65) Prior Publication Data

US 2010/0231470 A1 Sep. 16, 2010

Related U.S. Application Data

(60) Provisional application No. 61/159,694, filed on Mar. 12, 2009.

(51) Int. Cl.
*H01Q 13/10* (2006.01)
*H01Q 15/00* (2006.01)

(52) U.S. Cl.
CPC ..... *H01Q 13/10* (2013.01); *H01Q 15/0086* (2013.01)

(58) Field of Classification Search
CPC ..... H01Q 13/10; H01Q 13/085; H01Q 1/38
USPC ..... 343/767, 770, 768
See application file for complete search history.

(56) References Cited

U.S. PATENT DOCUMENTS 6,842,140 B2 1/2005 Killen
7,592,957 B2 9/2009 Achour et al.
2002/0196192 A1* 12/2002 Nagumo et al. ..... 343/700 MS
2003/0160728 A1* 8/2003 Fukushima et al. ..... 343/702
2006/0208957 A1* 9/2006 Iizuka et al. ..... 343/801
2007/0222698 A1* 9/2007 Poilasne et al. ..... 343/866
2008/0258981 A1 10/2008 Achour et al.
2008/0258993 A1* 10/2008 Gummalla et al. ..... 343/876
2009/0033558 A1 2/2009 Chung
2009/0058731 A1 3/2009 Geary et al.

(Continued)

FOREIGN PATENT DOCUMENTS

CN 1588689 A 3/2005
CN 102422487 A 4/2012

(Continued)

OTHER PUBLICATIONS

International Application Application Serial No. PCT/US2010/027238, International Search Report mailed Oct. 27, 2010, 3 pgs.

(Continued)

*Primary Examiner* — Dameon E Levi
*Assistant Examiner* — Collin Dawkins

(57) ABSTRACT

An antenna device includes a substrate having a first surface and a second surface. A first conductive layer is formed on the first surface of the substrate, the first conductive layer having a perimeter defined by one or more shapes having straight or curved edges. The first conductive layer defines a slot and a coupling gap, and also includes a top ground. The coupling gap separates the top ground from a metal plate region. A second conductive layer is formed on the second surface of the substrate, the second conductive layer including a bottom ground. The slot, coupling gap, first conductive layer, and substrate form a composite right and left handed (CRLH) structure.

28 Claims, 36 Drawing Sheets

(56) References Cited

U.S. PATENT DOCUMENTS

| | | | | |
|---|---|---|---|---|
| 2009/0128446 | A1 | 5/2009 | Gummalla et al. | |
| 2009/0135087 | A1 | 5/2009 | Gummalla et al. | |
| 2009/0184876 | A1 * | 7/2009 | Liu | 343/700 MS |
| 2009/0219213 | A1 * | 9/2009 | Lee et al. | 343/700 MS |
| 2009/0295660 | A1 | 12/2009 | Xu et al. | |
| 2010/0045554 | A1 | 2/2010 | Xu et al. | |
| 2010/0085262 | A1 * | 4/2010 | Wolf | 343/768 |

FOREIGN PATENT DOCUMENTS

| | | | | |
|---|---|---|---|---|
| KR | 1020120003883 | | 1/2012 | |
| WO | WO-2008021993 | A2 | 2/2008 | |
| WO | WO 2008024993 | A2 * | 2/2008 | H01Q 1/38 |
| WO | WO-2010064826 | A2 | 6/2010 | |
| WO | WO-2010105230 | A2 | 9/2010 | |

OTHER PUBLICATIONS

Gani, H, et al., "Arbitrary dual-band circularly polarized patch antenna", IEEE International Workshop on Antenna Technology: Small Antennas and Novel Metamaterials, 2005. IWAT 2005., (2005), 254-257.

Sasaki, Y, et al., "Slotted composite right/left-handed strip lines for leaky wave antenna applications", Asia-Pacific Microwave Conference, 2006. APMC 2006., (Dec. 2006), 923-926.

Sato, K, et al., "Composite right/left-handed leaky wave antenna for millimeter-wave automotive applications", First European Conference on Antennas and Propagation, 2006. EuCAP 2006., (Nov. 2006), 1-4.

Weitsch, Y, et al., "Continuous Beam-Steering Leaky-Wave Antenna Based on Substrate Integrated Waveguide", The Second European Conference on Antennas and Propagation, 2007. EuCAP 2007., (Nov. 2007), 1-5.

"Chinese Application Serial No. 201080020717.2, Office Action mailed Jul. 16, 2013", (w/ English Trans)ation), 16 pgs.

Caloz and Itoh, "Electromagnetic Metamaterials: Transmission Line Theory and Microwave Applications," John Wiley & Sons (2006).

Tatsuo ITOH in "Invited paper: Prospects for Metamaterials," Electronics Letters, vol. 40, No. 16 (Aug. 2004) pp. 972-973.

"Chinese Application Serial No. 201080020717.2, Office Action mailed Jan. 9, 2014", (W/English Translation), 11 pgs.

"Chinese Application Serial No. 201080020717.2, Response filed Apr. 21, 2014 to Office Action mailed Jam. 9, 2014", (W/ English Translation of Claims), 7 pgs.

"Chinese Application Serial No. 201080020717.2, Response filed Nov. 29, 2013 to Office Action mailed Jul. 16, 2013", (W/ English Translation of Claims), 8 pgs.

"European Application Serial No. 10751518.1, Extended European Search Report mailed Mar. 28, 2014", 7 pgs.

Kim, Dowon, et al., "A Super-Directive Zeroth-Order Resonator Slot Antenna", Asia-Pacific Microwave Conference 2007, XP031279881, ISBN: 978-1-4244-0748-4, (Dec. 11, 2007), 1-4.

"Chinese Application Serial No. 201080020717.2, Office Action mailed Jul. 30, 2014", w/English Translation, 14 pgs.

"European Application Serial No. 10751518.1, Response filed Oct. 23, 2014 to Search Report mailed Mar. 28, 2014", 16 pgs.

"Chinese Application Serial No. 201080020717.2, Response filed Oct. 14, 2014 to Office Action mailed Jul. 30, 2014", (W/ English Translation of Claims), 9 pgs.

"Chinese Applicaiton Serial No. 201080020717.2 Response filed May 19, 2015 to Office Action mailed Jan. 4, 2015", With the Chinese claims, 8 pgs.

"Chinese Application U.S. Appl. No. 201080020717.2, Office Action mailed Jan. 4, 2015", 9 pgs.

* cited by examiner

MULTIBAND COMPOSITE RIGHT AND LEFT HANDED (CRLH) SLOT ANTENNA

PRIORITY CLAIMS AND RELATED APPLICATIONS

This application claims the benefits of U.S. Provisional Patent Application Ser. No. 61/159,694 entitled "MULTI-BAND METAMATERIAL SLOT ANTENNA" and filed on Mar. 12, 2009.

The disclosure of the above application is hereby incorporated by reference as part of the specification of this application.

BACKGROUND

A conventional slot antenna is generally made up of a one piece planar metal surface, such as a metal plate, with a hole or slot formed in the metal surface. By design, a slot antenna may be considered structurally complementary to a dipole antenna. For example, a printed dipole antenna on dielectric substrate, having similar shape and size to a printed slot antenna, may be formed by interchanging the conductive material layer on the dielectric substrate and open slot area of the slot antenna and vice versa. Both antennas may be similar in form and have similar electromagnetic wave patterns. Factors determining the radiation pattern of the slot antenna, as with the dipole antenna, include shape and size of the slot. Slot antennas can be used in various wireless communication systems due to certain advantages it offers over conventional antenna designs. Some advantages include a smaller size than other conventional antenna designs, lower fabrication costs, design simplicity, durability, and integration. However, slot antenna designs may still have limitations on the size reduction since the antenna size is primarily dependent on a center frequency, thus making the size reduction a challenge at certain frequencies.

DETAILED DESCRIPTION

Figure 1:
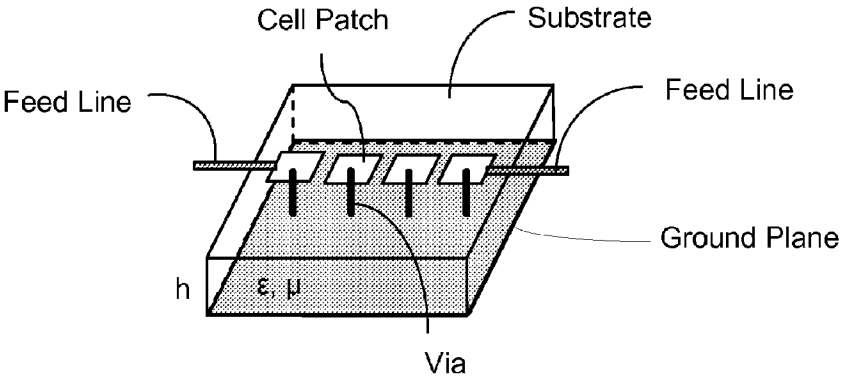
FIGS. 1-3 illustrate examples of one dimensional composite right and left handed metamaterial transmission lines based on four unit cells, according to example embodiments.

As technological advances in the field of wireless communications continue to push mobile devices to increasingly smaller dimensions, compact antenna designs have become one of the most difficult challenges to meet. For example, due to the limited space available in a compact wireless device, a smaller conventional antenna may lead to reduced performance and complex mechanical design assemblies which, in turn, may result in higher manufacturing costs. One possible design solution includes a conventional slot antenna design, which may include a conductive surface having at least one aperture formed in the conductive surface. Because slot antennas are typically formed using a single piece of metal, these types are generally less expensive and easier to build. The slot antenna design may provide several other advantages over conventional antenna designs such as reduced size, simplicity, durability, and integration into compact devices. Reducing the size of the slot antenna, however, may reach certain size limitations since the antenna size can be primarily dependent on the operational frequency. To meet the on-going challenges of antenna size reduction, slot antenna designs based on composite right and left handed (CRLH) metamaterial (MTM) structures may be a possible solution to achieve smaller antenna designs over the conventional slot antennas or CRLH antennas described in the U.S. patent application Ser. No. 11/741,674 entitled "Antennas, Devices and Systems Based on Metamaterial Structures," filed on Apr. 27, 2007; and the U.S. Pat. No. 7,592,957 entitled "Antennas Based on Metamaterial Structures," issued on Sep. 22, 2009. Furthermore, these CRLH slot antenna offer low fabrication costs, design simplicity, durability, integration, and multi-band operation, sharing similar performance advantages with the conventional slot antenna and CRLH antenna.

A CRLH slot antenna may be combined with a CRLH antenna in a multi-antenna system to achieve certain performance advantages over multi-antenna system based entirely on CRLH antennas or solely on CRLH slot antennas. For example, since the CRLH antenna possesses electrical current on the antenna structure, and the CRLH slot antenna possesses magnetic current on the antenna structure, the coupling between the CRLH antenna and the CRLH slot antenna may be substantially smaller than the coupling between two CRLH antennas or two CRLH slot antennas. Therefore, by combining a CRLH antenna with a CRLH slot antenna in a multiple antenna system, such as a MIMO/Diversity device, coupling between the two different antennas may be substantially reduced and thus improve antenna efficiency and far-field envelope correlation which, in turn, improves the performance of the antenna system.

This application provides several embodiments of slot antenna devices and slot antenna devices based on Composite Right and Left Handed (CRLH) structures.

CRLH Metamaterial Structures

The basic structural elements of a CRLH MTM antenna is provided in this disclosure as a review and serve to describe fundamental aspects of CRLH antenna structures used in a balanced MTM antenna device. For example, the one or more antennas in the above and other antenna devices described in this document may be in various antenna structures, including right-handed (RH) antenna structures and CRLH structures. In a right-handed (RH) antenna structure, the propagation of electromagnetic waves obeys the right-hand rule for the (E,H, $\beta$) vector fields, considering the electrical field E, the magnetic field H, and the wave vector $\beta$ (or propagation constant). The phase velocity direction is the same as the direction of the signal energy propagation (group velocity) and the refractive index is a positive number. Such materials are referred to as Right Handed (RH) materials. Most natural materials are RH materials. Artificial materials can also be RH materials.

A metamaterial may be an artificial structure or, as detailed hereinabove, an MTM component may be designed to behave as an artificial structure. In other words, the equivalent circuit describing the behavior and electrical composition of the component is consistent with that of an MTM. When designed with a structural average unit cell size $\rho$ much smaller than the wavelength $\lambda$ of the electromagnetic energy guided by the metamaterial, the metamaterial can behave like a homogeneous medium to the guided electromagnetic energy. Unlike RH materials, a metamaterial can exhibit a negative refractive index, and the phase velocity direction may be opposite to the direction of the signal energy propagation wherein the relative directions of the (E,H,$\beta$) vector fields follow the left-hand rule. Metamaterials having a negative index of refraction and have simultaneous negative permittivity $\in$ and permeability $\mu$ are referred to as pure Left Handed (LH) metamaterials.

Many metamaterials are mixtures of LH metamaterials and RH materials and thus are CRLH metamaterials. A CRLH metamaterial can behave like an LH metamaterial at low frequencies and an RH material at high frequencies. Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials may be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

Metamaterial structures may be used to construct antennas, transmission lines and other RF components and devices, allowing for a wide range of technology advancements such as functionality enhancements, size reduction and performance improvements. An MTM structure has one or more MTM unit cells. As discussed above, the lumped circuit model equivalent circuit for an MTM unit cell includes an RH series inductance $L_R$, an RH shunt capacitance $C_R$, an LH series capacitance $C_L$, and an LH shunt inductance $L_L$. The MTM-based components and devices can be designed based on these CRLH MTM unit cells that can be implemented by using distributed circuit elements, lumped circuit elements or a combination of both. Unlike conventional antennas, the MTM antenna resonances are affected by the presence of the LH mode. In general, the LH mode helps excite and better match the low frequency resonances as well as improves the matching of high frequency resonances. The MTM antenna structures can be configured to support multiple frequency bands including a "low band" and a "high band." The low band includes at least one LH mode resonance and the high band includes at least one RH mode resonance associated with the antenna signal.

Some examples and implementations of MTM antenna structures are described in the U.S. patent application Ser. No. 11/741,674 entitled "Antennas, Devices and Systems Based on Metamaterial Structures," filed on Apr. 27, 2007; and the U.S. Pat. No. 7,592,957 entitled "Antennas Based on Metamaterial Structures," issued on Sep. 22, 2009. These MTM antenna structures may be fabricated by using a conventional FR-4 Printed Circuit Board (PCB) or a Flexible Printed Circuit (FPC) board.

One type of MTM antenna structure is a Single-Layer Metallization (SLM) MTM antenna structure, wherein the conductive portions of the MTM structure are positioned in a single metallization layer formed on one side of a substrate. In this way, the CRLH components of the antenna are printed onto one surface or layer of the substrate. For a SLM device, the capacitively coupled portion and the inductive load portions are both printed onto a same side of the substrate.

A Two-Layer Metallization Via-Less (TLM-VL) MTM antenna structure is another type of MTM antenna structure having two metallization layers on two parallel surfaces of a substrate. A TLM-VL does not have conductive vias connecting conductive portions of one metallization layer to conductive portions of the other metallization layer. The examples and implementations of the SLM and TLM-VL MTM antenna structures are described in the U.S. patent application Ser. No. 12/250,477 entitled "Single-Layer Metallization and Via-Less Metamaterial Structures," filed on Oct. 13, 2008, the disclosure of which is incorporated herein by reference.

FIG. 1 illustrates an example of a 1-dimensional (1D) CRLH MTM transmission line (TL) based on four unit cells. One unit cell includes a cell patch and a via, and is a building block for constructing a desired MTM structure. The illustrated TL example includes four unit cells formed in two conductive metallization layers of a substrate where four conductive cell patches are formed on the top conductive metallization layer of the substrate and the other side of the substrate has a metallization layer as the ground electrode. Four centered conductive vias are formed to penetrate through the substrate to connect the four cell patches to the ground plane, respectively. The unit cell patch on the left side is electromagnetically coupled to a first feed line and the unit cell patch on the right side is electromagnetically coupled to a second feed line. In some implementations, each unit cell patch is electromagnetically coupled to an adjacent unit cell patch without being directly in contact with the adjacent unit cell. This structure forms the MTM transmission line to receive an RF signal from one feed line and to output the RF signal at the other feed line.

Figure 2:
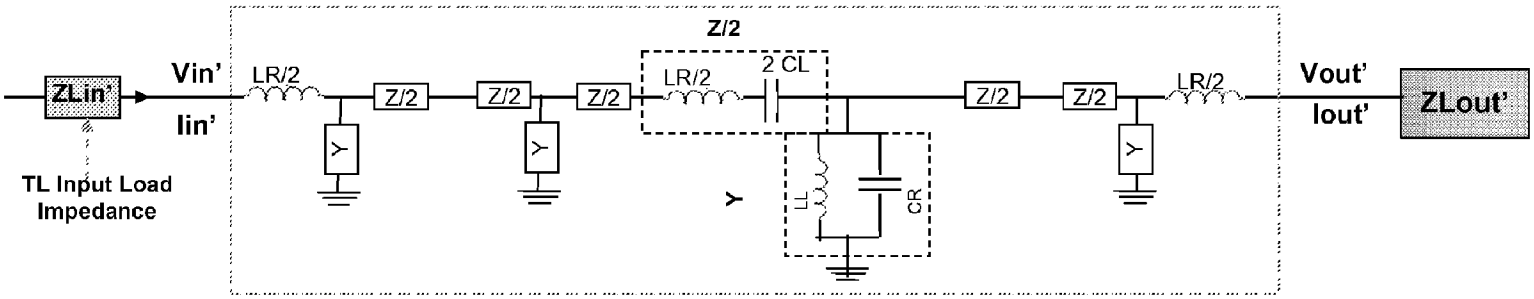

FIG. 2 shows an equivalent network circuit of the 1D CRLH MTM TL in FIG. 1. The ZLin' and ZLout' correspond to the TL input load impedance and TL output load impedance, respectively, and are due to the TL coupling at each end. This is an example of a printed two-layer structure. $L_R$ is due to the cell patch and the first feed line on the dielectric substrate, and $C_R$ is due to the dielectric substrate being sandwiched between the cell patch and the ground plane. $C_L$ is due to the presence of two adjacent cell patches, and the via induces $L_L$.

Each individual unit cell can have two resonances $\omega_{SE}$ and $\omega_{SH}$ corresponding to the series (SE) impedance Z and shunt (SH) admittance Y. In FIG. 2, the Z/2 block includes a series combination of LR/2 and 2CL, and the Y block includes a parallel combination of $L_L$ and $C_R$. The relationships among these parameters are expressed as follows:

$$\omega_{SH} = \frac{1}{\sqrt{L_L C_R}}; \quad \omega_{SE} = \frac{1}{\sqrt{L_R C_L}}; \quad \omega_R = \frac{1}{\sqrt{L_R C_R}}; \quad \omega_L = \frac{1}{\sqrt{L_L C_L}} \qquad \text{Eq. (1)}$$

where, $$Z = j\omega L_R + \frac{1}{j\omega C_L}$$

and $$Y = j\omega C_R + \frac{1}{j\omega L_L}.$$

The two unit cells at the input/output edges in FIG. 1 do not include $C_L$, since $C_L$ represents the capacitance between two adjacent cell patches and is missing at these input/output edges. The absence of the $C_L$ portion at the edge unit cells prevents $\omega_{SE}$ frequency from resonating. Therefore, only $\omega_{SH}$ appears as an m=0 resonance frequency.

Figure 3:
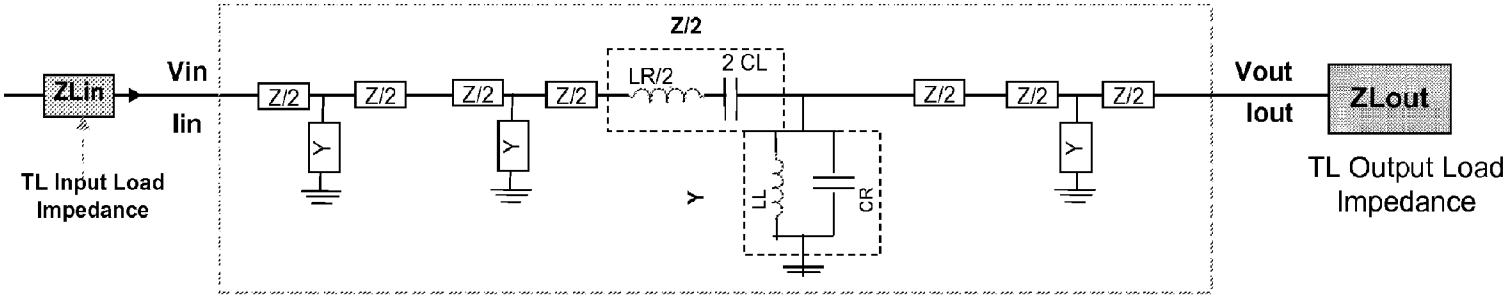

To simplify the computational analysis, a portion of the ZLin' and ZLout' series capacitor is included to compensate for the missing $C_L$ portion, and the remaining input and output load impedances are denoted as ZLin and ZLout, respectively, as seen in FIG. 3. Under this condition, ideally the unit cells have identical parameters as represented by two series Z/2 blocks and one shunt Y block in FIG. 3, where the Z/2 block includes a series combination of $L_R/2$ and $2C_L$, and the Y block includes a parallel combination of $L_L$ and $C_R$.

Figure 4A:
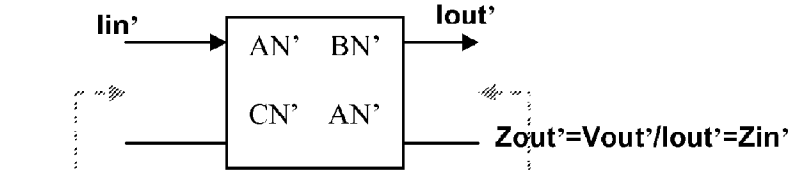
FIG. 4A illustrates a two-port network matrix representation for a one dimensional composite right and left handed metamaterial transmission line equivalent circuit as in FIG. 2, according to an example embodiment.
Figure 4B:
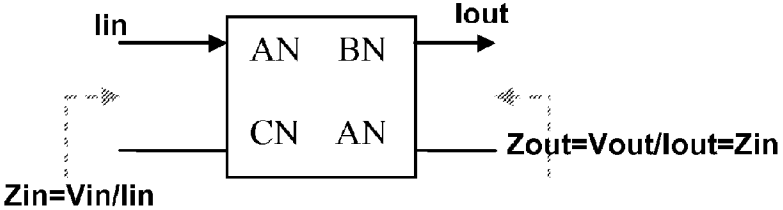
FIG. 4B illustrates a two-port network matrix representation for a one dimensional composite right and left handed metamaterial transmission line equivalent circuit as in FIG. 3, according to an example embodiment.

FIG. 4A and FIG. 4B illustrate a two-port network matrix representation for TL circuits without the load impedances as shown in FIG. 2 and FIG. 3, respectively. The matrix coefficients describing the input-output relationship are provided.

Figure 5:
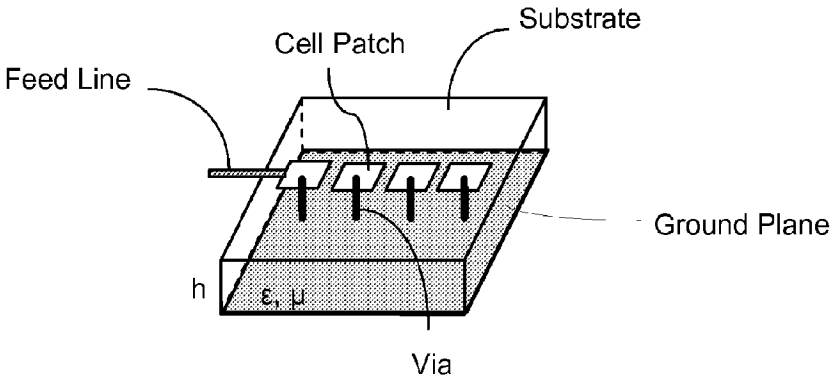
FIG. 5 illustrates a one dimensional composite right and left handed metamaterial antenna based on four unit cells, according to an example embodiment.

FIG. 5 illustrates an example of a 1D CRLH MTM antenna based on four unit cells. Different from the 1D CRLH MTM TL in FIG. 1, the antenna in FIG. 5 couples the unit cell on the left side to a feed line to connect the antenna to a antenna circuit and the unit cell on the right side is an open circuit so that the four cells interface with the air to transmit or receive an RF signal.

Figure 6B:
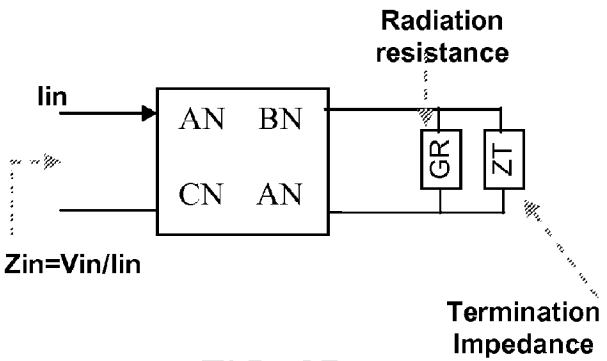
FIG. 6B illustrates a two-port network matrix representation for a one dimensional composite right and left handed metamaterial antenna equivalent circuit analogous to a TL case as in FIG. 4B, according to an example embodiment.
Figure 6A:
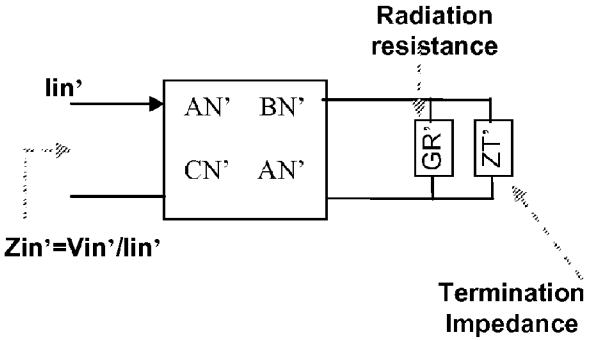
FIG. 6A illustrates a two-port network matrix representation for a one dimensional composite right and left handed metamaterial antenna equivalent circuit analogous to a transmission line case as in FIG. 4A, according to an example embodiment.

FIG. 6A shows a two-port network matrix representation for the antenna circuit in FIG. 5. FIG. 6B shows a two-port network matrix representation for the antenna circuit in FIG. 5 with the modification at the edges to account for the missing $C_L$ portion to have all the unit cells identical. FIGS. 6A and 6B are analogous to the TL circuits shown in FIGS. 4A and 4B, respectively.

In matrix notations, FIG. 4B represents the relationship given as below:

$$\begin{pmatrix} Vin \\ Iin \end{pmatrix} = \begin{pmatrix} AN & BN \\ CN & AN \end{pmatrix} \begin{pmatrix} Vout \\ Iout \end{pmatrix}, \quad \text{Eq. (2)}$$

where AN=DN because the CRLH MTM TL circuit in FIG. 3 is symmetric when viewed from Vin and Vout ends.

In FIGS. 6A and 6B, the parameters GR' and GR represent a radiation resistance, and the parameters ZT' and ZT represent a termination impedance. Each of ZT', ZLin' and ZLout' includes a contribution from the additional $2C_L$ as expressed below:

$$ZLin' = Zlin + \frac{2}{j\omega CL}, \quad \text{Eq. (3)}$$

$$ZLout' = ZLout + \frac{2}{j\omega CL},$$

$$ZT' = ZT + \frac{2}{j\omega CL}.$$

Since the radiation resistance GR or GR' can be derived by either building or simulating the antenna, it may be difficult to optimize the antenna design. Therefore, it is preferable to adopt the TL approach and then simulate its corresponding antennas with various terminations ZT. The relationships in Eq. (1) are valid for the circuit in FIG. 2 with the modified values AN', BN', and CN', which reflect the missing $C_L$ portion at the two edges.

The frequency bands can be determined from the dispersion equation derived by letting the N CRLH cell structure resonate with $n\pi$ propagation phase length, where n=0, ±1, ±2, . . . ±N. Here, each of the N CRLH cells is represented by Z and Y in Eq. (1), which is different from the structure shown in FIG. 2, where $C_L$ is missing from end cells. Therefore, one might expect that the resonances associated with these two structures are different. However, extensive calculations show that all resonances are the same except for n=0, where both $\omega_{SE}$ and $\omega_{SH}$ resonate in the structure in FIG. 3, and only $\omega_{SH}$ resonates in the structure in FIG. 2. The positive phase offsets (n>0) correspond to RH region resonances and the negative values (n<0) are associated with LH region resonances.

The dispersion relation of N identical CRLH cells with the Z and Y parameters is given below:

$$\begin{cases} N\beta p = \cos^{-1}(A_N), \Rightarrow |A_N| \le 1 \Rightarrow 0 \le \chi = -ZY \le 4 \forall N \\ \text{where } A_N = 1 \text{ at even resonances } |n| = 2m \in \left\{ \begin{matrix} 0, 2, 4, \ldots 2\times \\ \mathrm{Int}\left(\frac{N-1}{2}\right) \end{matrix} \right\} \\ \text{and } A_N = -1 \text{ at odd resonances } |n| = 2m+1 \in \left\{ \begin{matrix} 1, 3, \ldots \\ \left(2\times \mathrm{Int}\left(\frac{N}{2}\right) - 1\right) \end{matrix} \right\}, \end{cases} \quad \text{Eq. (4)}$$

where Z and Y are given in Eq. (1), AN is derived from the linear cascade of N identical CRLH unit cells as in FIG. 3, and p is the cell size. Odd n=(2m+1) and even n=2m resonances are associated with AN=−1 and AN=1, respectively. For AN' in FIG. 4A and FIG. 6A, the n=0 mode resonates at $\omega_0=\omega_{SH}$ only and not at both $\omega_{SE}$ and $\omega_{SH}$ due to the absence of $C_L$ at the end cells, regardless of the number of cells. Higher-order frequencies are given by the following equations for the different values of $\chi$ specified in Table 1:

For $n > 0$, Eq. (5)

$$\omega_{\pm n}^2 = \frac{\omega_{SH}^2 + \omega_{SE}^2 + \chi\omega_R^2}{2} \pm \sqrt{\left(\frac{\omega_{SH}^2 + \omega_{SE}^2 + \chi\omega_R^2}{2}\right)^2 - \omega_{SH}^2\omega_{SE}^2}.$$

Table 1 provides $\chi$ values for N=1, 2, 3, and 4. It should be noted that the higher-order resonances |n|>0 are the same regardless if the full $C_L$ is present at the edge cells (FIG. 3) or absent (FIG. 2). Furthermore, resonances close to n=0 have small $\chi$ values (near $\chi$ lower bound 0), whereas higher-order resonances tend to reach $\chi$ upper bound 4 as stated in Eq. (4).

TABLE 1

Resonances for N = 1, 2, 3 and 4 cells

| | Modes | | | |
|---|---|---|---|---|
| N | \|n\| = 0 | \|n\| = 1 | \|n\| = 2 | \|n\| = 3 |
| N = 1 | $\chi_{(1,0)} = 0$; $\omega_0 = \omega_{SH}$ | | | |
| N = 2 | $\chi_{(2,0)} = 0$; $\omega_0 = \omega_{SH}$ | $\chi_{(2,1)} = 2$ | | |
| N = 3 | $\chi_{(3,0)} = 0$; $\omega_0 = \omega_{SH}$ | $\chi_{(3,1)} = 1$ | $\chi_{(3,2)} = 3$ | |
| N = 4 | $\chi_{(4,0)} = 0$; $\omega_0 = \omega_{SH}$ | $\chi_{(4,1)} = 2 - \sqrt{2}$ | $\chi_{(4,2)} = 2$ | |

Figure 7A:
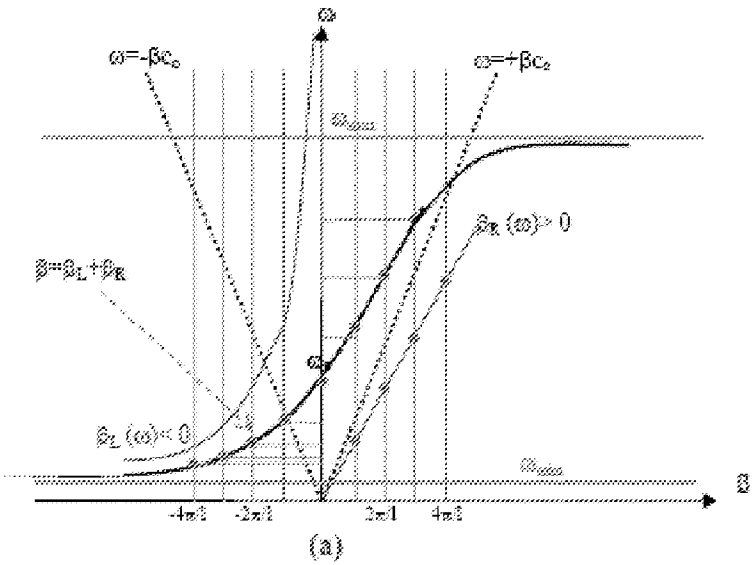
FIGS. 7A and 7B are dispersion curves of a unit cell as in FIG. 2 considering balanced and unbalanced cases, respectively, according to an example embodiment.
Figure 7B:
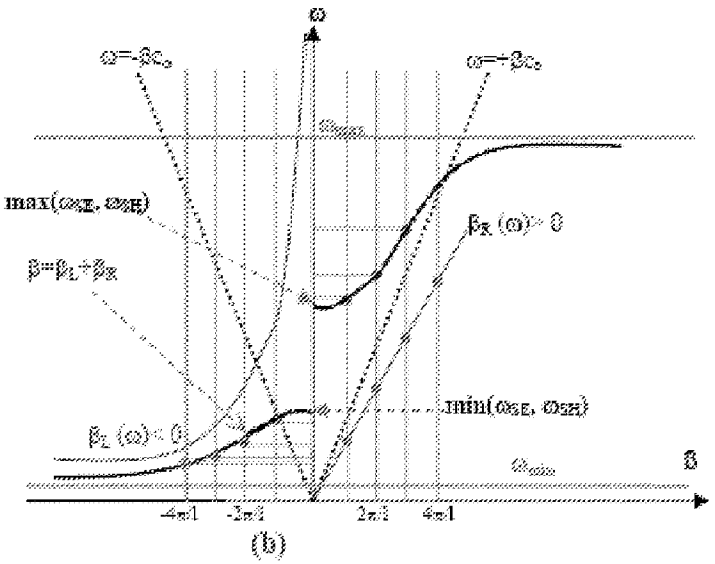

The CRLH dispersion curve β for a unit cell as a function of frequency ω is illustrated in FIGS. 7A and 7B for the $\omega_{SE}=\omega_{SH}$ (balanced, i.e., $L_R C_L = L_L C_R$) and $\omega_{SE}\neq\omega_{SH}$ (unbalanced) cases, respectively. In the latter case, there is a frequency gap between min ($\omega_{SE}$, $\omega_{SH}$) and max ($\omega_{SE}$, $\omega_{SH}$). The limiting frequencies $\omega_{min}$ and $\omega_{max}$ values are given by the same resonance equations in Eq. (5) with $\chi$ reaching its upper bound $\chi$=4 as stated in the following equations:

$$\omega_{min}^2 = \frac{\omega_{SH}^2 + \omega_{SE}^2 + 4\omega_R^2}{2} - \sqrt{\left(\frac{\omega_{SH}^2 + \omega_{SE}^2 + 4\omega_R^2}{2}\right)^2 - \omega_{SH}^2\omega_{SE}^2} \quad (6)$$

$$\omega_{max}^2 = \frac{\omega_{SH}^2 + \omega_{SE}^2 + 4\omega_R^2}{2} + \sqrt{\left(\frac{\omega_{SH}^2 + \omega_{SE}^2 + 4\omega_R^2}{2}\right)^2 - \omega_{SH}^2\omega_{SE}^2}.$$

In addition, FIGS. 7A and 7B provide examples of the resonance position along the dispersion curves. In the RH region (n>0) the structure size l=Np, where p is the cell size, increases with decreasing frequency. In contrast, in the LH region, lower frequencies are reached with smaller values of Np, hence size reduction. The dispersion curves provide some indication of the bandwidth around these resonances. For instance, LH resonances have the narrow bandwidth because the dispersion curves are almost flat. In the RH region, the bandwidth is wider because the dispersion curves are steeper. Thus, the first condition to obtain broadbands, $1^{st}$ BB condition, can be expressed as follows:

$$COND1: 1^{st}BB \text{ condition} \left|\frac{d\beta}{d\omega}\right|_{res} = \left|-\frac{\frac{d(AN)}{d\omega}}{\sqrt{(1-AN^2)}}\right|_{res} << 1 \text{ near } \omega = \omega_{res} = \omega_0, \omega_{\pm 1}, \omega_{\pm 2} \ldots \quad \text{Eq. (7)}$$

$$\Rightarrow \left|\frac{d\beta}{d\omega}\right| = \left|\frac{\frac{d\chi}{d\omega}}{2p\sqrt{\chi\left(1-\frac{\chi}{4}\right)}}\right|_{res} << 1 \text{ with } p = \text{cell size and } \frac{d\chi}{d\omega}\Big|_{res} = \frac{2\omega_{\pm n}}{\omega_R^2}\left(1-\frac{\omega_{SE}^2\omega_{SH}^2}{\omega_{\pm n}^4}\right),$$

where $\chi$ is given in Eq. (4) and $\omega_R$ is defined in Eq. (1). The dispersion relation in Eq. (4) indicates that resonances occur when $|AN|=1$, which leads to a zero denominator in the $1^{st}$ BB condition (COND1) of Eq. (7). As a reminder, AN is the first transmission matrix entry of the N identical unit cells (FIG. 4B and FIG. 6B). The calculation shows that COND1 is indeed independent of N and given by the second equation in Eq. (7). It is the values of the numerator and $\chi$ at resonances, which are shown in Table 1, that define the slopes of the dispersion curves, and hence possible bandwidths. Targeted structures are at most $Np=\lambda/40$ in size with the bandwidth exceeding 4%. For structures with small cell sizes p, Eq. (7) indicates that high $\omega_R$ values satisfy COND1, i.e., low $C_R$ and $L_R$ values, since for n<0 resonances occur at $\chi$ values near 4 in Table 1, in other terms $(1-\chi/4\rightarrow 0)$.

As previously indicated, once the dispersion curve slopes have steep values, then the next step is to identify suitable matching. Ideal matching impedances have fixed values and may not require large matching network footprints. Here, the word "matching impedance" refers to a feed line and termination in the case of a single side feed such as in antennas. To analyze an input/output matching network, Zin and Zout can be computed for the TL circuit in FIG. 4B. Since the network in FIG. 3 is symmetric, it is straightforward to demonstrate that Zin=Zout. It can be demonstrated that Zin is independent of N as indicated in the equation below:

$$Zin^2 = \frac{BN}{CN} = \frac{B1}{C1} = \frac{Z}{Y}\left(1-\frac{\chi}{4}\right), \quad \text{Eq. (8)}$$

which has only positive real values. One reason that B1/C1 is greater than zero is due to the condition of $|AN|\leq 1$ in Eq. (4), which leads to the following impedance condition:

$$0\leq -ZY=\chi\leq 4.$$

The $2^{nd}$ broadband (BB) condition is for Zin to slightly vary with frequency near resonances in order to maintain constant matching. Remember that the real input impedance Zin' includes a contribution from the $C_L$ series capacitance as stated in Eq. (3). The $2^{nd}$ BB condition is given below:

$$COND2: 2^{ed}\text{BB condition near resonances, } \frac{dZin}{d\omega}\Big|_{near\ res} << 1. \quad \text{Eq. (9)}$$

Different from the transmission line example in FIG. 2 and FIG. 3, antenna designs have an open-ended side with an infinite impedance which poorly matches the structure edge impedance. The capacitance termination is given by the equation below:

$$Z_T = \frac{AN}{CN}, \quad \text{Eq. (10)}$$

which depends on N and is purely imaginary. Since LH resonances are typically narrower than RH resonances, selected matching values are closer to the ones derived in the n<0 region than the n>0 region.

One method to increase the bandwidth of LH resonances is to reduce the shunt capacitor CR. This reduction can lead to higher $\omega_R$ values of steeper dispersion curves as explained in Eq. (7). There are various methods of decreasing CR, including but not limited to: 1) increasing substrate thickness, 2) reducing the cell patch area, 3) reducing the ground area under the top cell patch, resulting in a "truncated ground," or combinations of the above techniques.

The MTM TL and antenna structures in FIGS. 1 and 5 use a conductive layer to cover the entire bottom surface of the substrate as the full ground electrode. A truncated ground electrode that has been patterned to expose one or more portions of the substrate surface can be used to reduce the area of the ground electrode to less than that of the full substrate surface. This can increase the resonant bandwidth and tune the resonant frequency. Two examples of a truncated ground structure are discussed with reference to FIGS. 8 and 11, where the amount of the ground electrode in the area in the footprint of a cell patch on the ground electrode side of the substrate has been reduced, and a remaining strip line (via line) is used to connect the via of the cell patch to a main ground electrode outside the footprint of the cell patch. This truncated ground approach may be implemented in various configurations to achieve broadband resonances.

Figure 8:
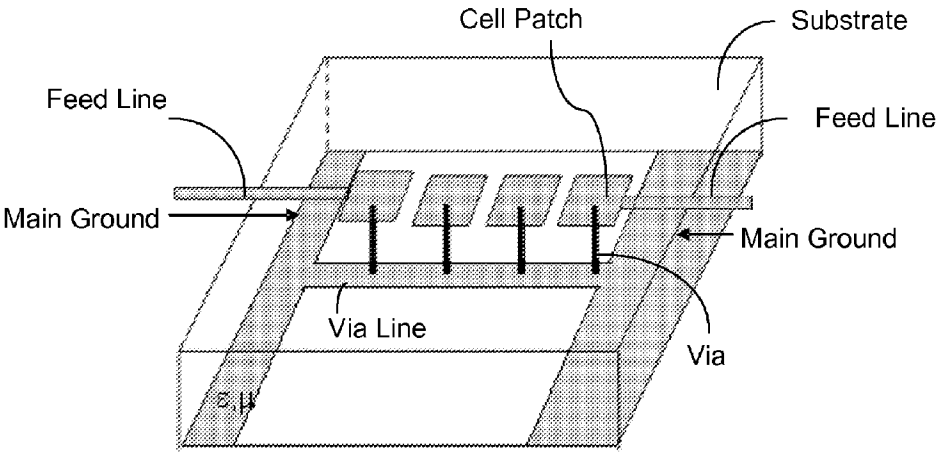
FIG. 8 illustrates a one dimensional composite right and left handed metamaterial transmission line with a truncated ground based on four unit cells, according to an example embodiment.
Figure 9:
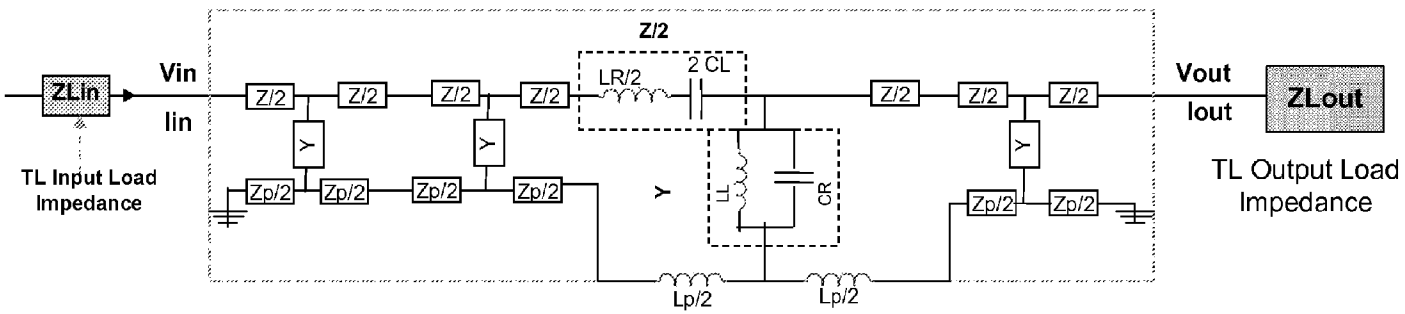
FIG. 9 illustrates an equivalent circuit of a one dimensional composite right and left handed metamaterial transmission line with the truncated ground as in FIG. 8, according to an example embodiment.
Figure 10:
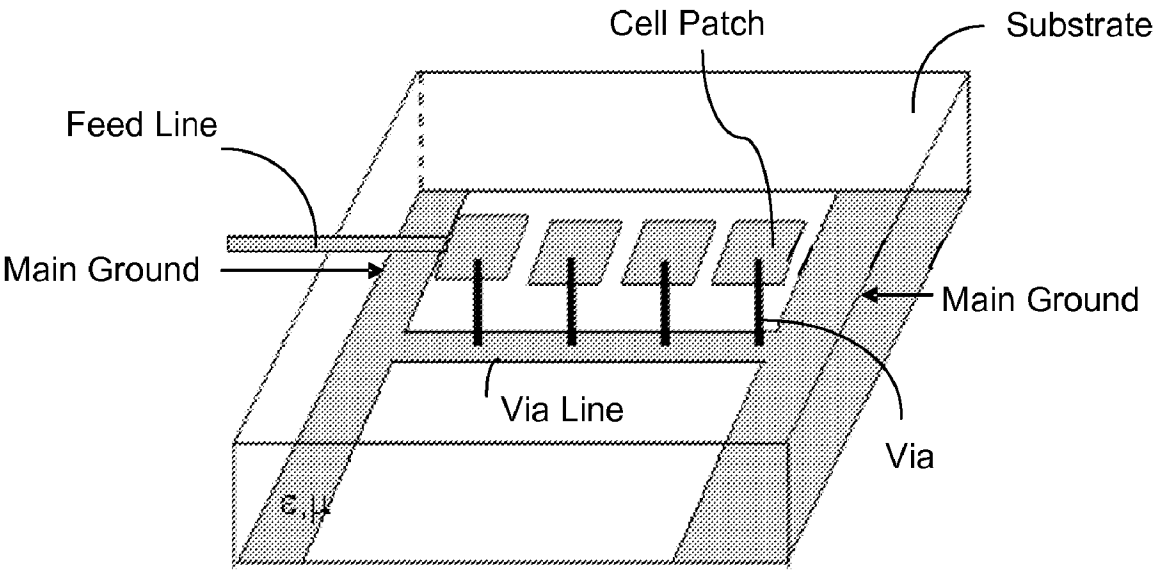
FIG. 10 illustrates an example of a one dimensional composite right and left handed metamaterial antenna with a truncated ground based on four unit cells, according to an example embodiment.

FIG. 8 illustrates one example of a truncated ground electrode for a four-cell MTM transmission line where the ground electrode has a dimension that is less than the cell patch along one direction underneath the cell patch. The ground conductive layer includes a via line that is connected to the vias and passes through underneath the cell patches. The via line has a width that is less than a dimension of the cell path of each unit cell. The use of a truncated ground may be a preferred choice over other methods in implementations of commercial devices where the substrate thickness cannot be increased or the cell patch area cannot be reduced because of the associated decrease in antenna efficiencies. When the ground is truncated, another inductor Lp (FIG. 9) is introduced by the metallization strip (via line) that connects the vias to the main ground as illustrated in FIG. 8. FIG. 10 shows a four-cell antenna counterpart with the truncated ground analogous to the TL structure in FIG. 8.

Figure 11:
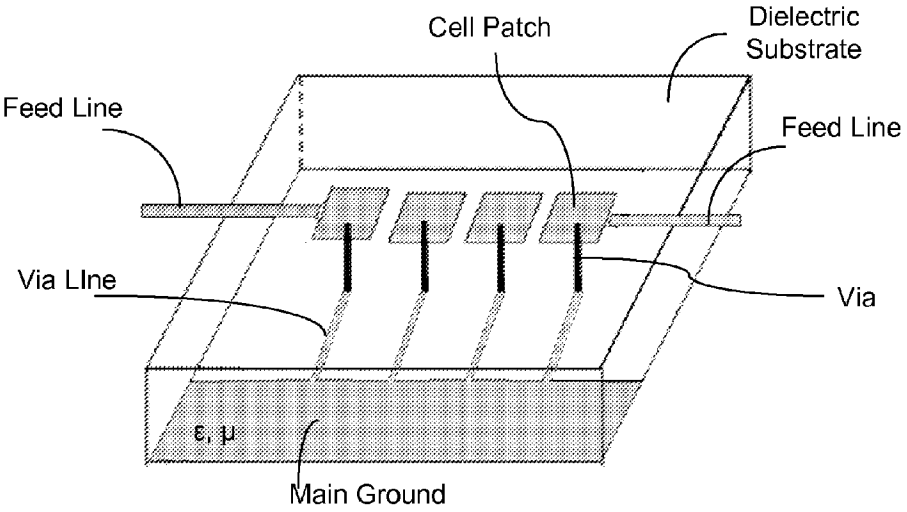
FIG. 11 illustrates another example of a one dimensional composite right and left handed metamaterial transmission line with a truncated ground based on four unit cells, according to an example embodiment.

FIG. 11 illustrates another example of a MTM antenna having a truncated ground structure. In this example, the ground conductive layer includes via lines and a main ground that is formed outside the footprint of the cell patches. Each via line is connected to the main ground at a first distal end and is connected to the via at a second distal end. The via line has a width that is less than a dimension of the cell path of each unit cell.

The equations for the truncated ground structure can be derived. In the truncated ground examples, the shunt capacitance $C_R$ becomes small, and the resonances follow the same equations as in Eqs. (1), (5) and (6) and Table 1. Two approaches are presented. FIGS. 8 and 9 represent the first approach, Approach 1, wherein the resonances are the same as in Eqs. (1), (5) and (6) and Table 1 after replacing $L_R$ by (LR+Lp). For $|n|\neq 0$, each mode has two resonances corresponding to (1) $\omega\pm n$ for $L_R$ being replaced by ($L_R$+Lp) and (2) $\omega\pm n$ for $L_R$ being replaced by ($L_R$+Lp/N) where N is the number of unit cells. Under this Approach 1, the impedance equation becomes:

$$Zin^2 = \frac{BN}{CN} = \frac{B1}{C1} = \frac{Z}{Y}\left(1 - \frac{\chi + \chi_P}{4}\right)\frac{(1 - \chi - \chi_P)}{(1 - \chi - \chi_P/N)}, \quad \text{Eq. (11)}$$

where $$\chi = -YZ \text{ and } \chi = -YZ_P,$$

where Zp=jωLp and Z, Y are defined in Eq. (2). The impedance equation in Eq. (11) provides that the two resonances ω and ω' have low and high impedances, respectively. Thus, it is easy to tune near the ω resonance in most cases.

Figure 12:
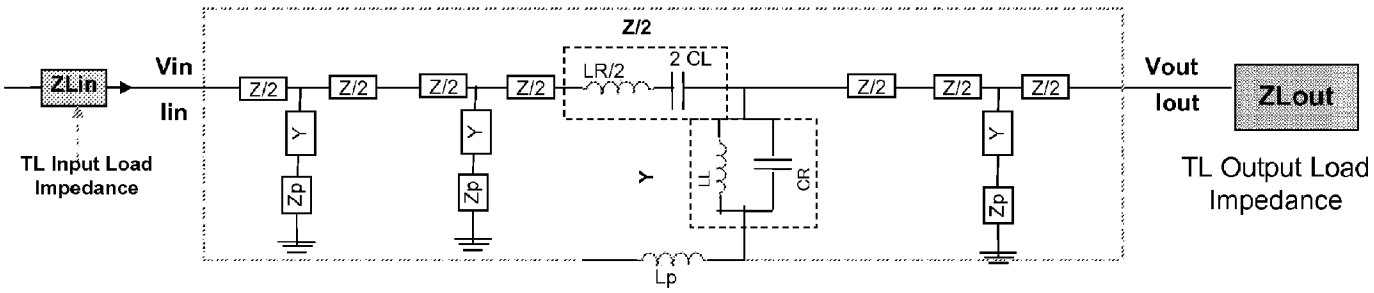
FIG. 12 illustrates an equivalent circuit of the one dimensional composite right and left handed metamaterial transmission line with the truncated ground as in FIG. 11, according to an example embodiment.

The second approach, Approach 2, is illustrated in FIGS. 11 and 12 and the resonances are the same as in Eqs. (1), (5), and (6) and Table 1 after replacing $L_L$ by ($L_L$+Lp). In the second approach, the combined shunt inductor ($L_L$+Lp) increases while the shunt capacitor $C_R$ decreases, which leads to lower LH frequencies.

The above exemplary MTM structures are formed on two metallization layers and one of the two metallization layers is used as the ground electrode and is connected to the other metallization layer through a conductive via. Such two-layer CRLH MTM TLs and antennas with a via can be constructed with a full ground electrode as shown in FIGS. 1 and 5 or a truncated ground electrode as shown in FIGS. 8 and 10.

In one embodiment, an SLM MTM structure includes a substrate having a first substrate surface and an opposite substrate surface, a metallization layer formed on the first substrate surface and patterned to have two or more conductive portions to form the SLM MTM structure without a conductive via penetrating the dielectric substrate. The conductive portions in the metallization layer include a cell patch of the SLM MTM structure, a ground that is spatially separated from the cell patch, a via line that interconnects the ground and the cell patch, and a feed line that is capacitively coupled to the cell patch without being directly in contact with the cell patch. The LH series capacitance $C_L$ is generated by the capacitive coupling through the gap between the feed line and the cell patch. The RH series inductance $L_R$ is mainly generated in the feed line and the cell patch. There is no dielectric material vertically sandwiched between the two conductive portions in this SLM MTM structure. As a result, the RH shunt capacitance $C_R$ of the SLM MTM structure may be designed to be negligibly small. A small RH shunt capacitance $C_R$ can still be induced between the cell patch and the ground, both of which are in the single metallization layer. The LH shunt inductance $L_L$ in the SLM MTM structure is negligible due to the absence of the via penetrating the substrate, but the via line connected to the ground can generate inductance equivalent to the LH shunt inductance $L_L$. A TLM-VL MTM antenna structure may have the feed line and the cell patch positioned in two different layers to generate vertical capacitive coupling.

Different from the SLM and TLM-VL MTM antenna structures, a multilayer MTM antenna structure has conductive portions in two or more metallization layers which are connected by at least one via. The examples and implementations of such multilayer MTM antenna structures are described in the U.S. patent application Ser. No. 12/270,410 entitled "Metamaterial Structures with Multilayer Metallization and Via," filed on Nov. 13, 2008, the disclosure of which is incorporated herein by reference. These multiple metallization layers are patterned to have multiple conductive portions based on a substrate, a film or a plate structure where two adjacent metallization layers are separated by an electrically insulating material (e.g., a dielectric material). Two or more substrates may be stacked together with or without a dielectric spacer to provide multiple surfaces for the multiple metallization layers to achieve certain technical features or advantages. Such multilayer MTM structures may implement at least one conductive via to connect one conductive portion in one metallization layer to another conductive portion in another metallization layer. This allows connection of one conductive portion in one metallization layer to another conductive portion in the other metallization layer.

An implementation of a double-layer MTM antenna structure with a via includes a substrate having a first substrate surface and a second substrate surface opposite to the first surface, a first metallization layer formed on the first substrate surface, and a second metallization layer formed on the second substrate surface, where the two metallization layers are patterned to have two or more conductive portions with at least one conductive via connecting one conductive portion in the first metallization layer to another conductive portion in the second metallization layer. A truncated ground can be formed in the first metallization layer, leaving part of the surface exposed. The conductive portions in the second metallization layer can include a cell patch of the MTM structure and a feed line, the distal end of which is located close to and capacitively coupled to the cell patch to transmit an antenna signal to and from the cell patch. The cell patch is formed in parallel with at least a portion of the exposed surface. The conductive portions in the first metallization layer include a via line that connects the truncated ground in the first metallization layer and the cell patch in the second metallization layer through a via formed in the substrate. The LH series capacitance $C_L$ is generated by the capacitive coupling through the gap between the feed line and the cell patch. The RH series inductance $L_R$ is mainly generated in the feed line and the cell patch. The LH shunt inductance $L_L$ is mainly induced by the via and the via line. The RH shunt capacitance $C_R$ is mainly induced between the cell patch in the second metallization layer and a portion of the via line in the footprint of the cell patch projected onto the first metallization layer. An additional conductive line, such as a meander line, can be attached to the feed line to induce an RH monopole resonance to support a broadband or multiband antenna operation.

Examples of various frequency bands that can be supported by MTM antennas include frequency bands for cell phone and mobile device applications, WiFi applications, WiMax applications and other wireless communication applications. Examples of the frequency bands for cell phone and mobile device applications are: the cellular band (824-960 MHz) which includes two bands, CDMA (824-894 MHz) and GSM (880-960 MHz) bands; and the PCS/DCS band (1710-2170 MHz) which includes three bands, DCS (1710-1880 MHz), PCS (1850-1990 MHz) and AWS/WCDMA (2110-2170 MHz) bands.

A CRLH structure can be specifically tailored to comply with requirements of an application, such as PCB spatial constraints and layout factors, device performance requirements and other specifications. The cell patch in the CRLH structure can have a variety of geometrical shapes and dimensions, including, for example, rectangular, polygonal, irregular, circular, oval, or combinations of different shapes. The via line and the feed line can also have a variety of geometrical shapes and dimensions, including, for example, rectangular, polygonal, irregular, zigzag, spiral, meander or combinations of different shapes. The distal end of the feed line can be modified to form a launch pad to modify the capacitive coupling. Other capacitive coupling techniques may include forming a vertical coupling gap between the cell patch and the launch pad. The launch pad can have a variety of geometrical shapes and dimensions, including, e.g., rectangular, polygonal, irregular, circular, oval, or combinations of different shapes. The gap between the launch pad and cell patch can take a variety of forms, including, for example, straight line, curved line, L-shaped line, zigzag line, discontinuous line, enclosing line, or combinations of different forms. Some of the feed line, launch pad, cell patch and via line can be formed in different layers from the others. Some of the feed line, launch pad, cell patch and via line can be extended from one metallization layer to a different metallization layer. The antenna portion can be placed a few millimeters above the main substrate. Multiple cells may be cascaded in series to form a multi-cell 1D structure. Multiple cells may be cascaded in orthogonal directions to form a 2D structure. In some implementations, a single feed line may be configured to deliver power to multiple cell patches. In other implementations, an additional conductive line may be added to the feed line or launch pad in which this additional conductive line can have a variety of geometrical shapes and dimensions, including, for example, rectangular, irregular, zigzag, planar spiral, vertical spiral, meander, or combinations of different shapes. The additional conductive line can be placed in the top, mid or bottom layer, or a few millimeters above the substrate.

Another type of MTM antenna includes non-planar MTM antennas. Such non-planar MTM antenna structures arrange one or more antenna sections of an MTM antenna away from one or more other antenna sections of the same MTM antenna so that the antenna sections of the MTM antenna are spatially distributed in a non-planar configuration to provide a compact structure adapted to fit to an allocated space or volume of a wireless communication device, such as a portable wireless communication device. For example, one or more antenna sections of the MTM antenna can be located on a dielectric substrate while placing one or more other antenna sections of the MTM antenna on another dielectric substrate so that the antenna sections of the MTM antenna are spatially distributed in a non-planar configuration such as an L-shaped antenna configuration. In various applications, antenna portions of an MTM antenna can be arranged to accommodate various parts in parallel or non-parallel layers in a three-dimensional (3D) substrate structure. Such non-planar MTM antenna structures may be wrapped inside or around a product enclosure. The antenna sections in a non-planar MTM antenna structure can be arranged to engage to an enclosure, housing walls, an antenna carrier, or other packaging structures to save space. In some implementations, at least one antenna section of the non-planar MTM antenna structure is placed substantially parallel with and in proximity to a nearby surface of such a packaging structure, where the antenna section can be inside or outside of the packaging structure. In some other implementations, the MTM antenna structure can be made conformal to the internal wall of a housing of a product, the outer surface of an antenna carrier or the contour of a device package. Such non-planar MTM antenna structures can have a smaller footprint than that of a similar MTM antenna in a planar configuration and thus can be fit into a limited space available in a portable communication device such as a cellular phone. In some non-planar MTM antenna designs, a swivel mechanism or a sliding mechanism can be incorporated so that a portion or the whole of the MTM antenna can be folded or slid in to save space while unused. Additionally, stacked substrates may be used with or without a dielectric spacer to support different antenna sections of the MTM antenna and incorporate a mechanical and electrical contact between the stacked substrates to utilize the space above the main board.

Non-planar, 3D MTM antennas can be implemented in various configurations. For example, the MTM cell segments described herein may be arranged in non-planar, 3D configurations for implementing a design having tuning elements formed near various MTM structures. U.S. patent application Ser. No. 12/465,571 filed on May 13, 2009 and entitled "Non-Planar Metamaterial Antenna Structures", for example, discloses 3D antennas structure that can implement tuning elements near MTM structures. The entire disclosure of the application Ser. No. 12/465,571 is incorporated by reference as part of the disclosure of this document.

In one aspect, the application Ser. No. 12/465,571 discloses an antenna device to include a device housing comprising walls forming an enclosure and a first antenna part located inside the device housing and positioned closer to a first wall than other walls, and a second antenna part. The first antenna part includes one or more first antenna components arranged in a first plane close to the first wall. The second antenna part includes one or more second antenna components arranged in a second plane different from the first plane. This device includes a joint antenna part connecting the first and second antenna parts so that the one or more first antenna components of the first antenna section and the one or more second antenna components of the second antenna part are electromagnetically coupled to form a CRLH MTM antenna supporting at least one resonance frequency in an antenna signal and having a dimension less than one half of one wavelength of the resonance frequency. In another aspect, the application Ser. No. 12/465,571 discloses an antenna device structured to engage a packaging structure. This antenna device includes a first antenna section configured to be in proximity to a first planar section of the packaging structure and the first antenna section includes a first planar substrate, and at least one first conductive portion associated with the first planar substrate. A second antenna section is provided in this device and is configured to be in proximity to a second planar section of the packaging structure. The second antenna section includes a second planar substrate, and at least one second conductive portion associated with the second planar substrate. This device also includes a joint antenna section connecting the first and second antenna sections. The at least one first conductive portion, the at least one second conductive portion and the joint antenna section collectively form a CRLH MTM structure to support at least one frequency resonance in an antenna signal. In yet another aspect, the application Ser. No. 12/465,571 discloses an antenna device structured to engage to a packaging structure and including a substrate having a flexible dielectric material and two or more conductive portions associated with the substrate to form a CRLH MTM structure configured to support at least one frequency resonance in an antenna signal. The CRLH MTM structure is sectioned into a first antenna section configured to be in proximity to a first planar section of the packaging structure, a second antenna section configured to be in proximity to a second planar section of the packaging structure, and a third antenna section that is formed between the first and second antenna sections and bent near a corner formed by the first and second planar sections of the packaging structure.

Various slot antenna designs are provided in this document beginning with a basic slot antenna design and ending with a multi-band CRLH slot antenna design. The basic slot antenna design provides several common structural elements that are shared in the subsequent slot antenna designs presented herein, each subsequent embodiment building upon the previous design in both structure and functionality.

Figures 13A, 13B:
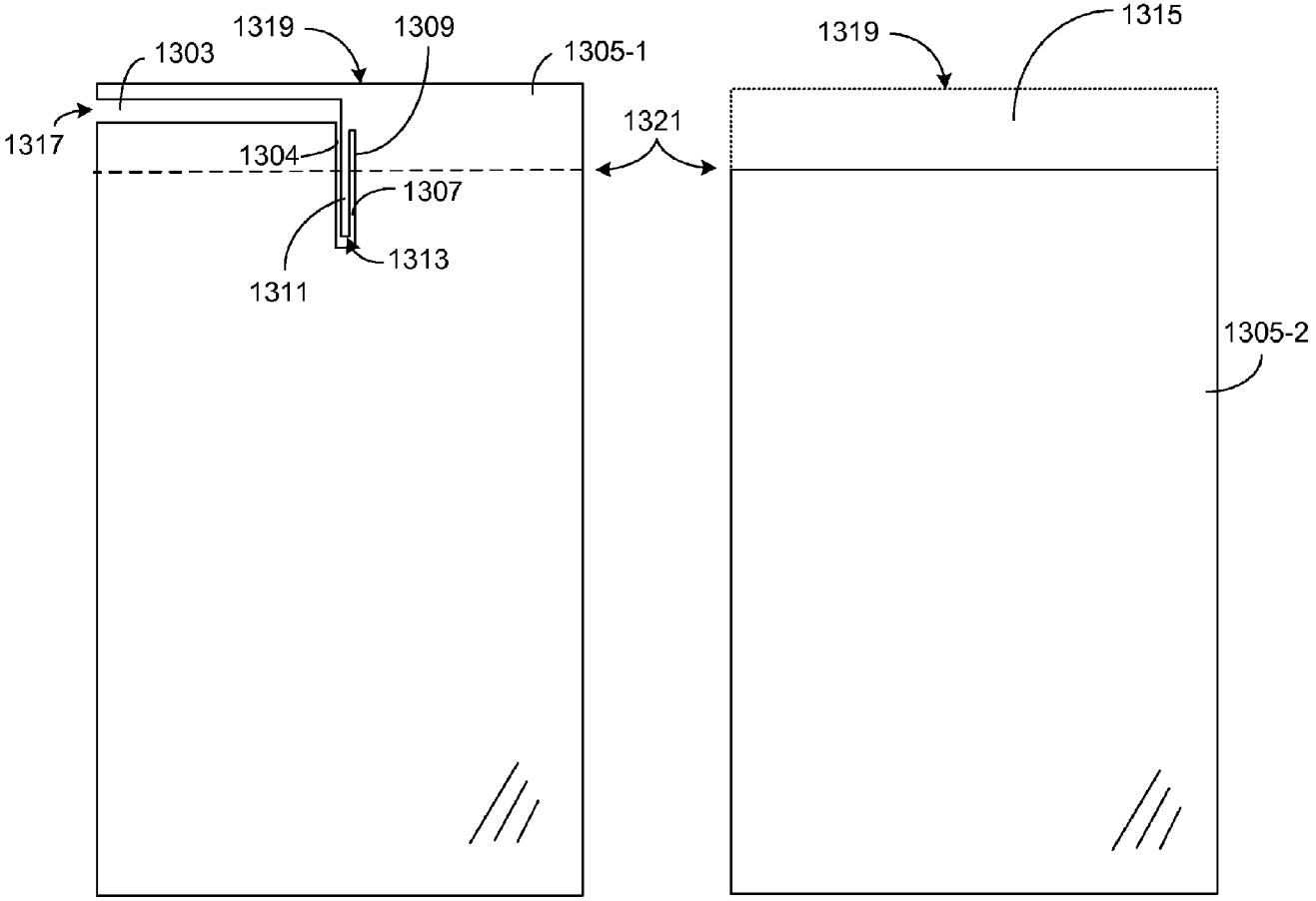
FIGS. 13A-13C illustrate multiple views of a basic slot antenna device, according to an example embodiment.
Figure 13C:
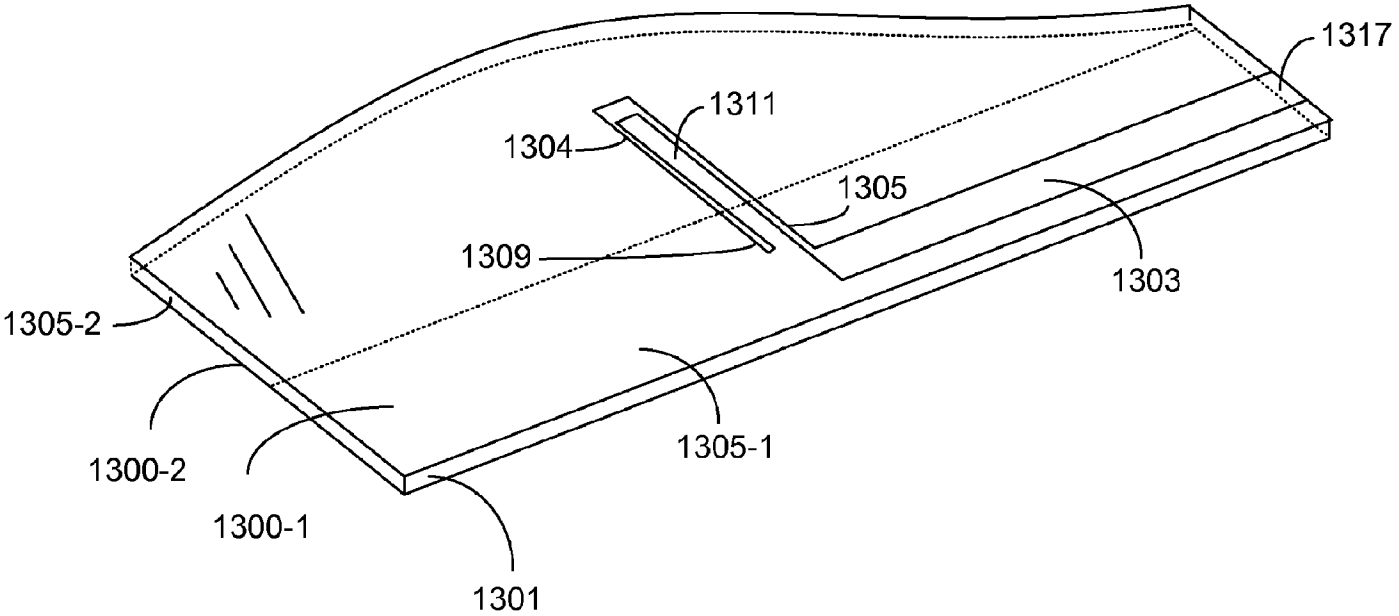

FIGS. 13A-13C illustrate multiple views of a basic slot antenna device 1300, according to an example embodiment. FIGS. 13A-13B represent a top view of a top conductive layer 1300-1 and a top view of a bottom conductive layer 1300-2, respectively.

In FIG. 13A, the top conductive layer 1300-1 of the basic slot antenna device 1300 may be formed on a first surface of a substrate 1301. Examples of a conductive layer include a metal plate, a sheet of metal, or other conductive planes, having a boundary or perimeter defining a variety of shapes and sizes of the conductive layer. In addition, the boundary or perimeter may be defined by one or more straight or curved lines. Several adjoining openings, which expose a portion of the substrate 1301 and have different orientations and sizes, are formed at a distal end of the top conductive layer 1300-1 to form a contiguous slot. Openings may be formed in the substrate by selectively removing certain sections of the top conductive layer 1300-1 using various etching methods such as mechanical or chemical etch systems. Sections of the contiguous slot may include an antenna slot section 1303, a connecting slot section 1304, a CPW slot section 1307, and a matching slot stub section 1309. Each slot sections 1303-1309 may be configured in different shapes including rectangles, triangles, circular or other polygon shapes. In this example, each slot sections 1303-1309 are configured to be rectangular in shape or a combination of rectangular shapes, but vary in orientation and size. For example, relative to a lateral edge of the substrate, the orientation of each rectangular shaped slot section 1303-1309 includes, but is not limited to, vertically or horizontally oriented openings. Other possible orientations include openings formed at any angle, ranging between 0° and 360°. Features of the contiguous aperture may be described in terms of its various slot sections 1303-1309. For example, the antenna slot section 1303 may be defined by forming an opening in the top conductive layer 1300-1, with the opening having a cutout portion 1317 located at a distal end of the top conductive layer 1300-1 and another portion adjacent to a top ground 1305-1. A second rectangular opening forms the connecting slot section 1304 which connects the antenna slot section 1303 to one end of the CPW slot section 1307, including multiple adjoining rectangular openings that form a U-shape structure. The other end of the CPW slot 1307 is connected to a free end of a rectangular opening that forms a matching slot stub section 1309, having a closed end formed in the top ground 1305-1.

In FIG. 13B, the bottom conductive layer 1300-2 of the slot antenna device 1300 may be formed on a second surface of the substrate 1301. Certain sections of the contiguous slot may be projected above the bottom conductive layer 1300-2 such as a bottom ground 1305-2, while other sections may be projected above a clear-out section 1315 formed in the bottom conductive layer 1300-2 as shown in FIG. 13B. The clear-out section 1315 may be formed by etch methods described above starting along an edge 1319 of the substrate 1301 and extending to another edge 1321.

Referring again to FIG. 13A, sections of the contiguous slot that are projected above the clear-out section 1315 include the antenna slot section 1303, the connection slot section 1304, and the matching slot stub section 1309. The section of the contiguous slot that is projected below the clear-out section 1315 includes the CPW slot section 1307. The top and bottom grounds 1305-1 and 1305-2 may be connected together by an array of vias (not shown) formed in the substrate to form an extended ground plane.

Referring to the top conductive layer 1300-1 in FIG. 13A, a portion of a metal conductive strip isolated by the CPW slot section 1307 defines a grounded coplanar waveguide (CPW) feed 1311. In this example, one end portion of the CPW feed 1311 may be coupled to a top ground 1305-1 while the other end portion may be coupled to an RF signal port 1313.

A number of design parameters and features of the slot antenna device 1300 can be used in designing the antenna for achieving certain antenna properties for specific applications. Some examples are provided below.

The substrate 1301 may measure, for example, 100 mm×60 mm×1 mm (length×width×thickness) and may include dielectric materials such as FR-4, FR-1, CEM-1 or CEM-3. These materials may have a dielectric constant measuring approximately 4.4, for example.

The dimension of the CPW feed 1311 may be designed to measure about 1.4 mm×8 mm. The dimension of the antenna slot section 1303 may be designed to measure about 3.00 mm×30.05 mm. The dimension of the connection slot section 1304 may be designed to measure about 0.4 mm×6.0 mm. The matching slot stub 1309 may be formed in proximity to the top ground 1305-1 where the matching slot stub is shorted to the antenna ground at 5 mm away from the top edge 1319 of the top ground 1305-1. The dimension of the clear-out section 1315 may be designed to measure about 11 mm×60 mm. The CPW feed 1311 may be designed to accommodate various impedances including, for example, 50 Ω.

In FIG. 13C, an isometric view of the antenna slot device 1300 is presented and illustrates the stacking orientation of the top conductive layer 1300-1, substrate 1301, and bottom conductive layer 1300-2. Various elements presented in FIGS. 13A-13B, such as the slot, CPW feed and ground of the top and bottom layers, are presented in the isometric view shown in FIG. 13C.

To operate the basic slot antenna device 1300, an RF source may be fed to the CPW feed port 1313 and the antenna ground 1305 to excite the slot antenna device 1300. A series inductance $L_R$ and a shunt capacitance $C_R$ may be induced along the conductive edges formed by the adjoining openings and by a current flow provided by the RF source. Structural elements defining the inductance $L_R$ may include one side of the CPW feed 1311 and a conductive edge adjacent to the upper side of the antenna slot 1303, as indicated by the bold dashed line 1401 shown in FIG. 14A. The shunt capacitance $C_R$ may be determined by the gap formed between two conductive plates 1403 and 1405, defining the antenna slot 1303 in the top conductive layer 1300-1.

Figure 14B:
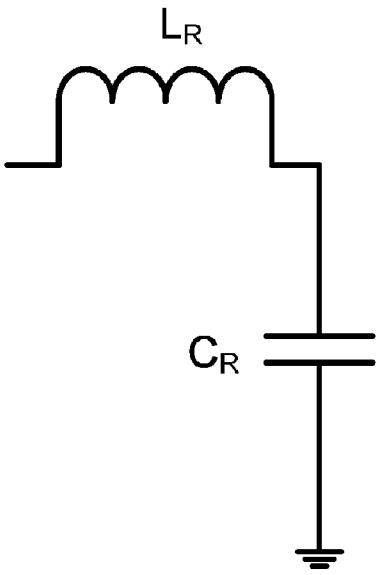
FIG. 14B illustrates an equivalent circuit model of the basic slot antenna device shown in FIGS. 13A-13C, according to an example embodiment.
Figure 14A:
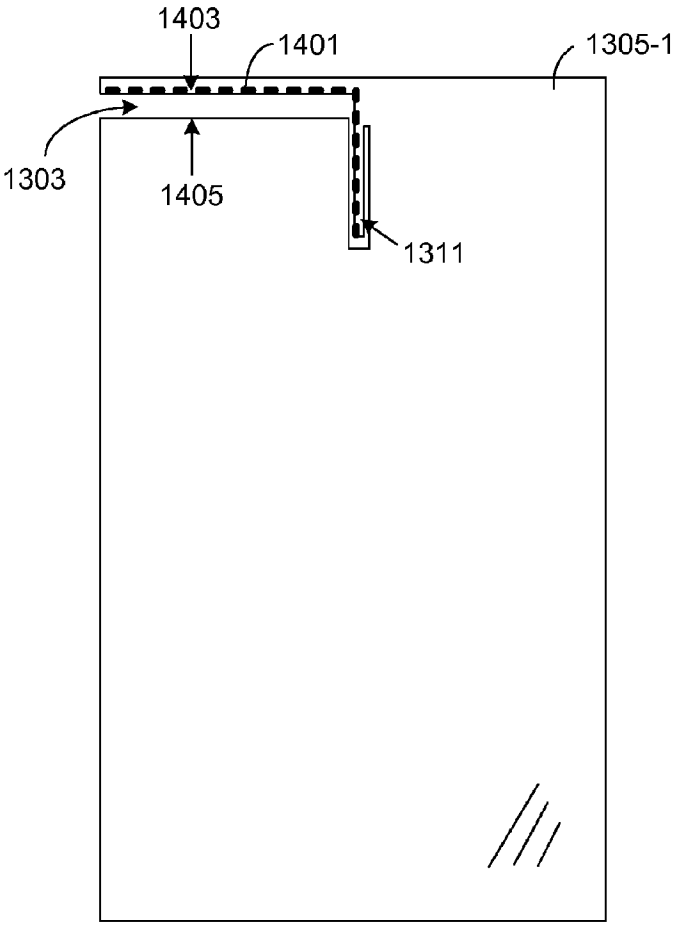
FIG. 14A illustrates structural elements defining certain inductance and capacitive elements of the slot antenna device of FIGS. 13A-13C, according to an example embodiment.

FIG. 14B illustrates an equivalent circuit model of the basic slot antenna device 1300 shown in FIGS. 13A-13C. The equivalent circuit model contains a series inductor $L_R$ and a shunt capacitor $C_R$ corresponding to the inductance and the capacitance defined by conductive sections forming the antenna slot section 1303, the connecting slot section 1304, and the CPW slot section 1307.

The series inductance $L_R$ and the shunt capacitance $C_R$ may contribute to a resonance produced in the RH region for the basic slot antenna device 1300. Simulation modeling tools can be applied to the basic slot antenna device 1300 for estimating operational frequency and other performance data. A few of these performance parameters include return loss and impedance plots.

Figure 15:
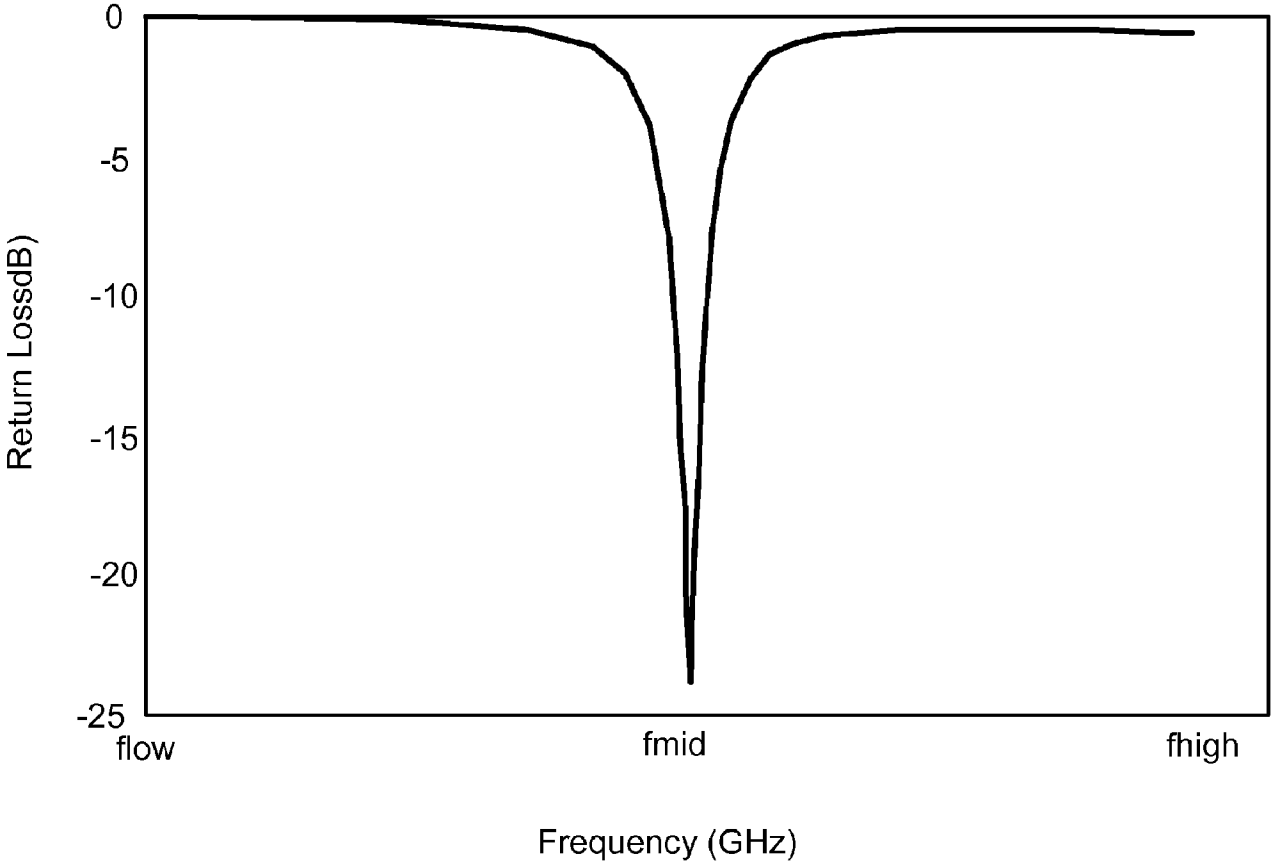
In FIG. 15 illustrates an HFSS simulated return loss of the basic slot antenna device is illustrated, according to an example embodiment.

In FIG. 15, an HFSS simulated return loss of the basic slot antenna device 1300 is illustrated. The simulated result in this figure indicates an operational frequency that radiates at approximately 1.53 GHz.

Figure 16:
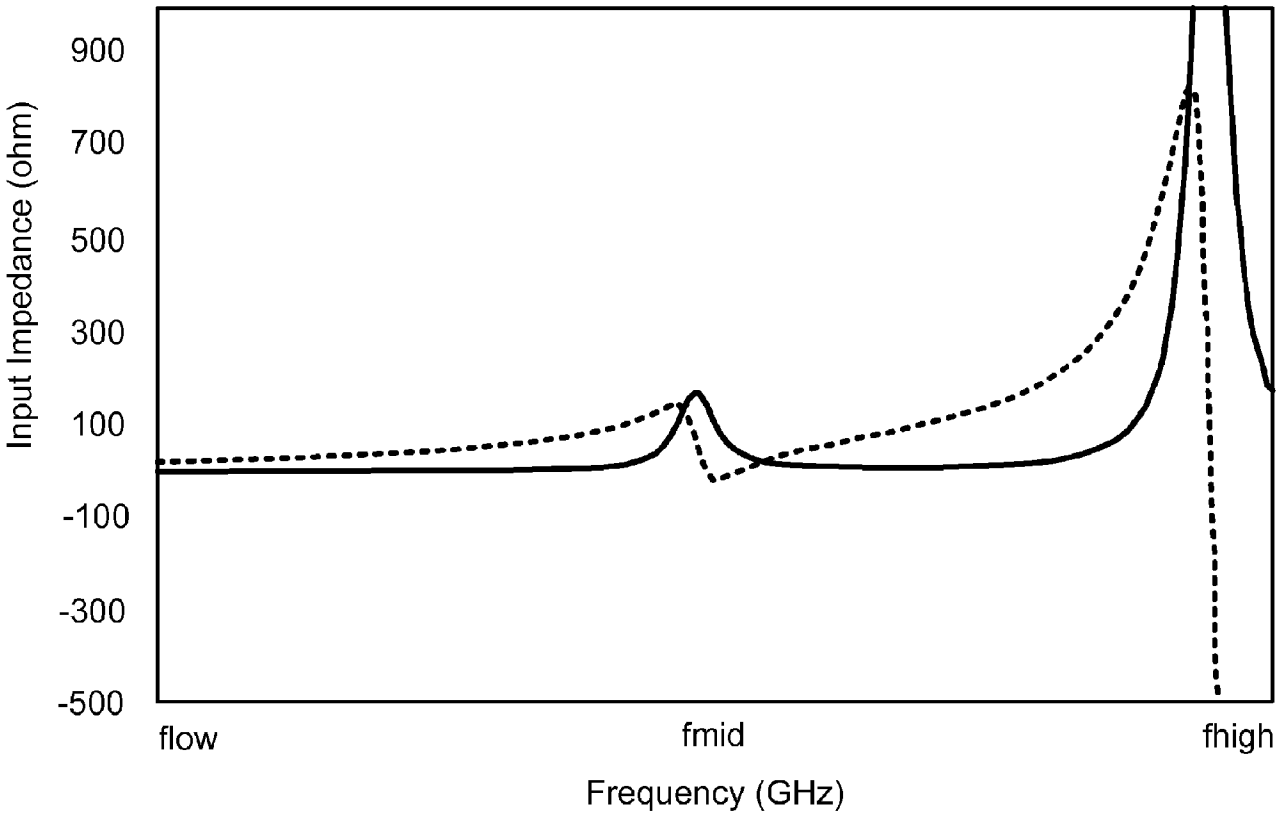
FIG. 16 illustrates both real and imaginary parts of the input impedance of the basic slot antenna device, according to an example embodiment.

FIG. 16 illustrates both real and imaginary parts of the input impedance of the basic slot antenna device 1300 as measured at the open end of the CPW feed 1313. The antenna resonance frequency, which may be extrapolated from this figure at a frequency of the real part when the imaginary part has an input impedance of 0 ohms, is approximately 1.49 GHz.

The simulated results indicate that a viable antenna design having at least one resonance frequency is possible for the basic slot antenna device 1300. Furthermore, these results may serve as a basis of comparison for other slot antenna designs provided in this document.

Figures 17A, 17B:
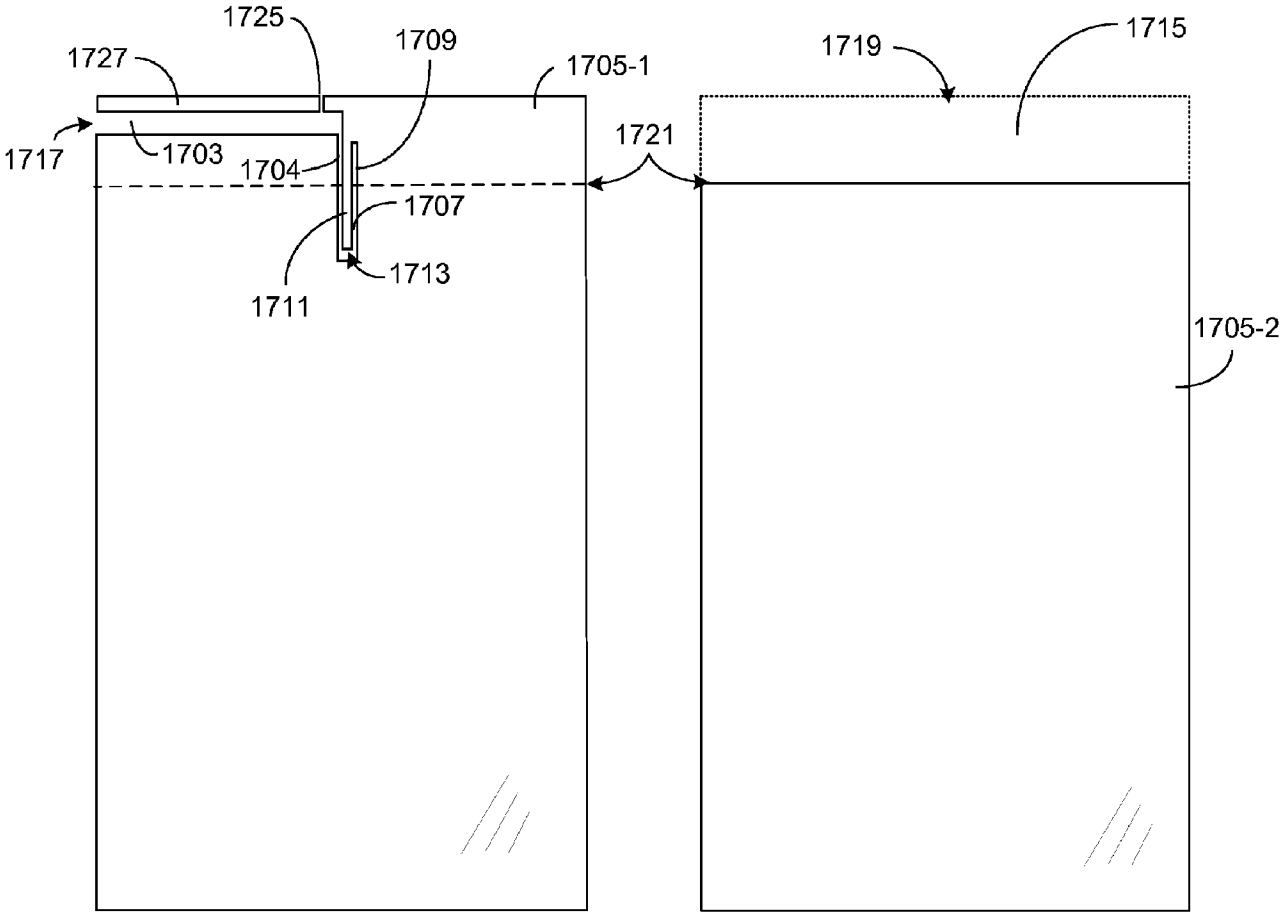
FIGS. 17A-17C illustrate multiple views of a second slot antenna device, according to an example embodiment, according to an example embodiment.
Figure 17C:
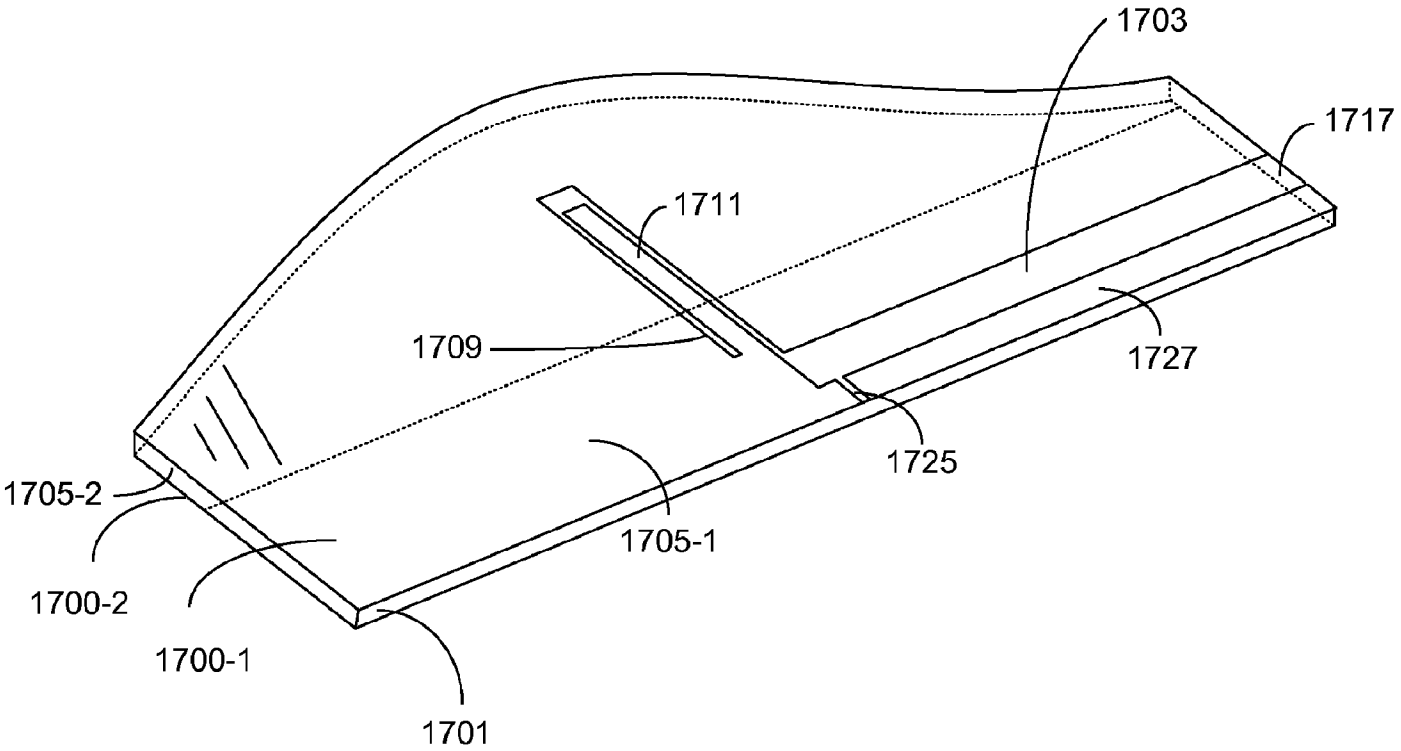

FIGS. 17A-17C illustrate multiple views of a second slot antenna device 1700, according to an example embodiment. FIGS. 17A-17B represent a top view of a top conductive layer 1700-1 and a top view of a bottom conductive layer 1700-2, respectively. Structurally, the design of the second slot antenna device 1700 is similar to the basic slot antenna device 1300 presented previously. However, a coupling gap is formed in the top conductive layer of the second slot antenna device 1700 as to change the operational frequency of this antenna device 1700 over the previous slot antenna design.

In FIG. 17A, the top conductive layer 1700-1 of the second slot antenna device 1700 may be formed on a first surface of a substrate 1701. Examples of a conductive layer include a metal plate, a sheet of metal, or other conductive planes, having a boundary or perimeter defining a variety of shapes and sizes of the conductive layer. In addition, the boundary or perimeter may be defined by one or more straight or curved lines. Several adjoining openings, which expose the substrate 1701 and have different orientations and sizes, are formed at a distal end of the top conductive layer 1700-1 to form a contiguous slot. Openings may be formed in the substrate by selectively removing certain portions of the top conductive layer 1700-1 using various etching methods such as mechanical or chemical etch systems. Sections of the contiguous slot may include an antenna slot section 1703, a connecting slot section 1704, a CPW slot section 1707, and a matching slot stub section 1709. Each slot sections 1703-1709 may be configured in different shapes including rectangles, triangles, circular or other polygon shapes. In this example, each slot sections 1703-1709 are configured to be rectangular in shape or a combination of rectangular shapes, but vary in orientation and size. For example, in reference to one edge of the substrate, the orientation of each rectangular shaped slot section 1703-1709 includes, but is not limited to, vertically or horizontally oriented openings. Other possible orientations may include openings formed at any angle, ranging between 0.degree. and 360.degree. Features of the contiguous aperture may be described in terms of its various slot sections 1703-1709. For example, the antenna slot section 1703 may be defined by forming an opening in the top conductive layer 1700-1, with the opening having a cutout portion 1717 located at a distal end of the top conductive layer 1700-1 and another portion adjacent to a top ground 1705-1. A second rectangular opening forms the connecting slot section 1704 which connects the antenna slot section 1703 to one end of the CPW slot section 1707, including multiple adjoining rectangular openings that form a U-shape structure. The other end of the CPW slot 1707 is connected to a free end of a rectangular opening that forms a matching slot stub section 1709, having a closed end formed in the top ground 1705-1. The contiguous slot may also include a coupling gap 1725 that is formed in the top conductive layer 1700-1, separating a metal plate 1727 from the top ground 1705-1.

In FIG. 17B, the bottom conductive layer 1700-2 of the slot antenna device 1700 may be formed on a second surface of the substrate 1701. Certain sections of the contiguous slot may be projected above the bottom conductive layer 1700-2 such as a bottom ground 1705-2, while other sections may be projected above a clear-out section 1715 formed in the bottom conductive layer 1700-2 as shown in FIG. 17B. The clear-out section 1715 may be formed by etch methods described above starting along an edge 1719 of the substrate 1701 and extending to another edge 1721.

Referring again to FIG. 17A, sections of the contiguous slot that are projected above the clear-out section 1715 include the antenna slot section 1703, the connection slot section 1705, and the matching slot stub section 1709. The section of the contiguous slot that is projected below the clear-out section 1715 includes the CPW slot section 1707. The top and bottom grounds 1705-1 and 1705-2 may be connected together by an array of vias (not shown) formed in the substrate to form an extended ground plane.

Referring to the top conductive layer 1700-1 in FIG. 17A, a portion of a metal conductive strip isolated by the CPW slot section 1707 defines a grounded coplanar waveguide (CPW) feed 1711. In this example, one end portion of the CPW feed 1711 may be coupled to a top ground 1705-1 while the other end portion may be coupled to an RF signal port 1713.

Several design parameters and features of the second slot antenna device 1700 can be used in designing the antenna to achieve certain antenna properties for specific applications. Some examples are provided below.

The substrate 1701 may measure, for example, 100 mm×60 mm×1 mm (length×width×thickness) and may include dielectric materials such as FR-4, FR-1, CEM-1 or CEM-3. These materials may have a dielectric constant measuring approximately 4.4, for example.

The dimension of the CPW feed 1711 may be designed to measure about 1.4 mm×8 mm. The dimension of the antenna slot section 1703 may be designed to measure about 3.00 mm×30.05 mm. The dimension of the connection slot section 1704 may be designed to measure about 0.4 mm×6.0 mm. The matching slot stub 1709 may be formed in proximity to the top ground 1705-1 where the matching slot stub 1709 is shorted to the top ground 1705-1 at 5 mm away from the top edge 1719 of the top ground 1705-1. In this implementation, the dimension of the coupling gap 1725 measures about 0.5 mm×2 mm and is located at about 1.05 mm away from the distal end of the antenna slot section 1703. The dimension of the clear-out section 1715 may be designed to measure about 11 mm×60 mm. The CPW feed 1711 may be designed to accommodate various impedances including, for example, 50 Ω.

In FIG. 17C, an isometric view of the second antenna slot device 1300 is presented and illustrates the stacking orientation of the top conductive layer 1700-1, substrate 1701, and bottom conductive layer 1700-2. Various elements presented in FIGS. 17A-17B, such as the slot, CPW feed and ground of the top and bottom layers, are presented in the isometric view shown in FIG. 17C.

The second slot antenna device 1700 may be activated by connecting an RF source to the CPW feed port 1713 and the antenna ground 1705 to excite the slot antenna device 1700. A series inductance $L_R$, a shunt capacitance $C_R$ and a series capacitance $C_L$ may be induced along the conductive edges formed by the adjoining openings and by a current flow provided by the RF source. The structural element defining the series inductance $L_R$ and a shunt capacitance $C_R$ of the second antenna device 1700 are similar to the basic antenna device 1300. For example, structural elements defining the inductance $L_R$ may include one side of the CPW feed 1711 and a conductive edge adjacent to the upper side of the antenna slot 1703, as indicated by the bold dashed line 1801 shown in FIG. 18A. The shunt capacitance $C_R$ may be determined by the gap formed between two conductive plates 1803 and 1805, defining the antenna slot 1703 in the top conductive layer 1700-1. In this example, the additional capacitance $C_L$ may be generated by the coupling gap 1725 formed between the top ground 1705-1 and the metal plate 1727 as shown in FIG. 18A.

Figure 18B:
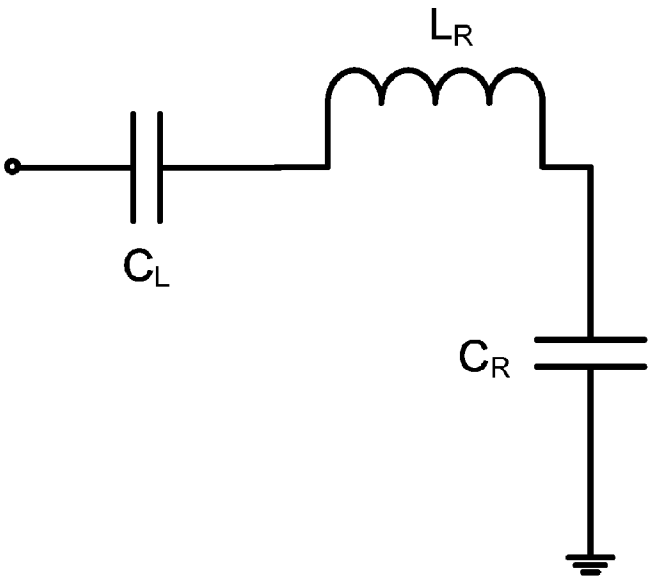
FIG. 18B illustrates an equivalent circuit model of the second slot antenna device shown in FIGS. 17A-17C, according to an example embodiment.
Figure 18A:
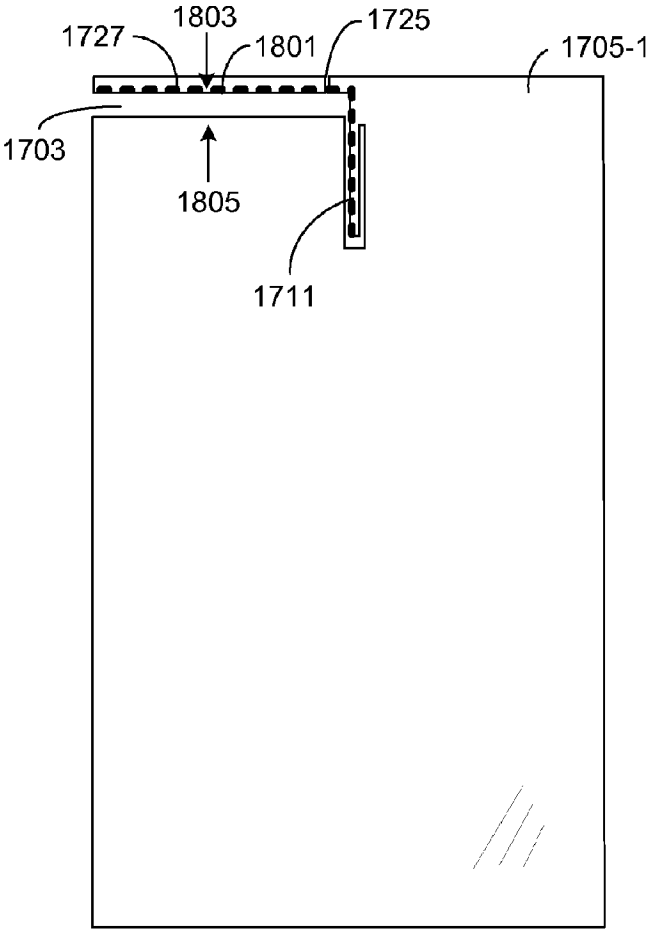
FIG. 18A illustrates structural elements defining certain inductance and capacitive elements of the second slot antenna device of FIGS. 17A-17C, according to an example embodiment.

FIG. 18B illustrates an equivalent circuit model of the second slot antenna device 1700 shown in FIGS. 17A-17C. The equivalent circuit model contains a series inductor $L_R$, a shunt capacitor $C_R$ and a series capacitor $C_L$ corresponding to the inductance and the capacitances defined by conductive sections forming the antenna slot section 1703, the connecting slot section 1704, the CPW slot section 1707, and the coupling gap 1725.

Figure 19:
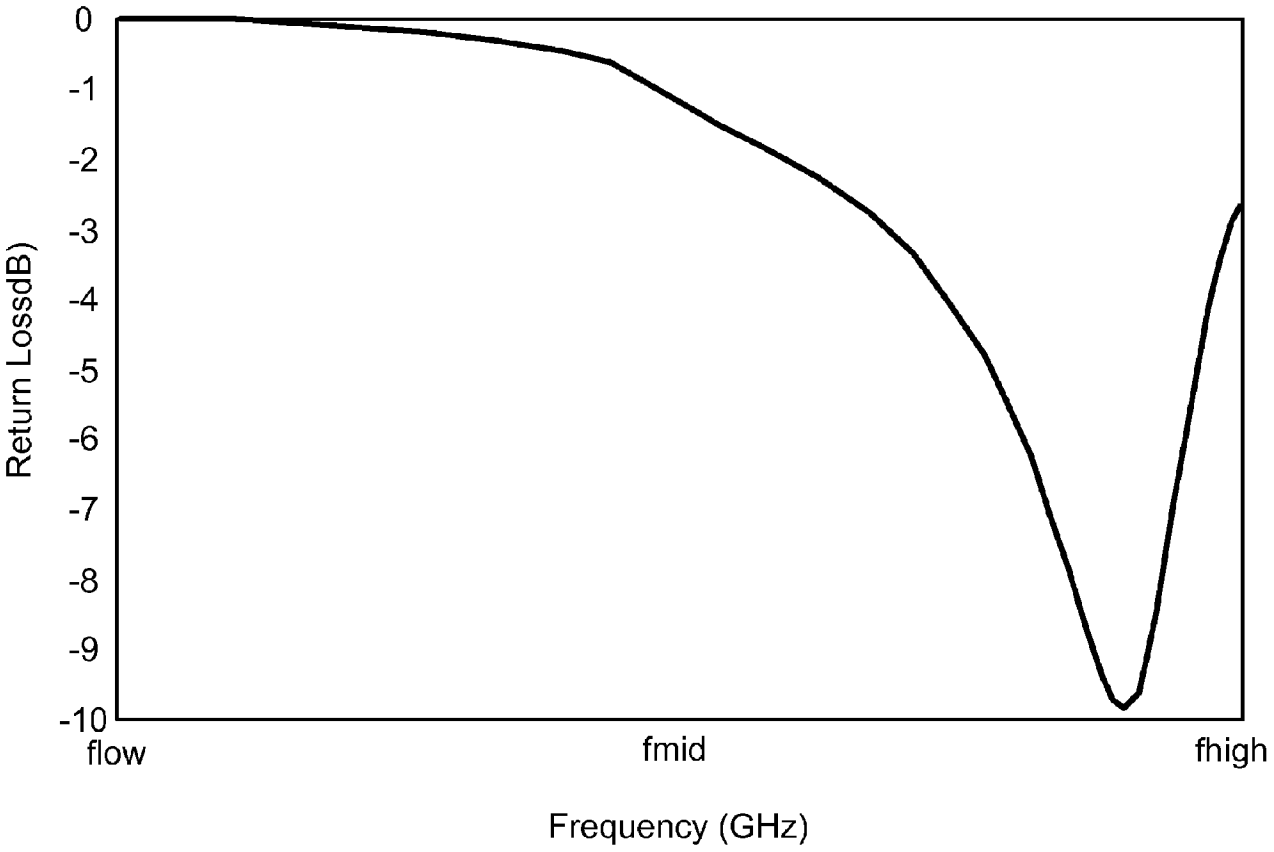
FIGS. 19 and 20 illustrate the simulated return loss and real and imaginary parts of the input impedance of the second slot antenna device, respectively, according to an example embodiment.
Figure 20:
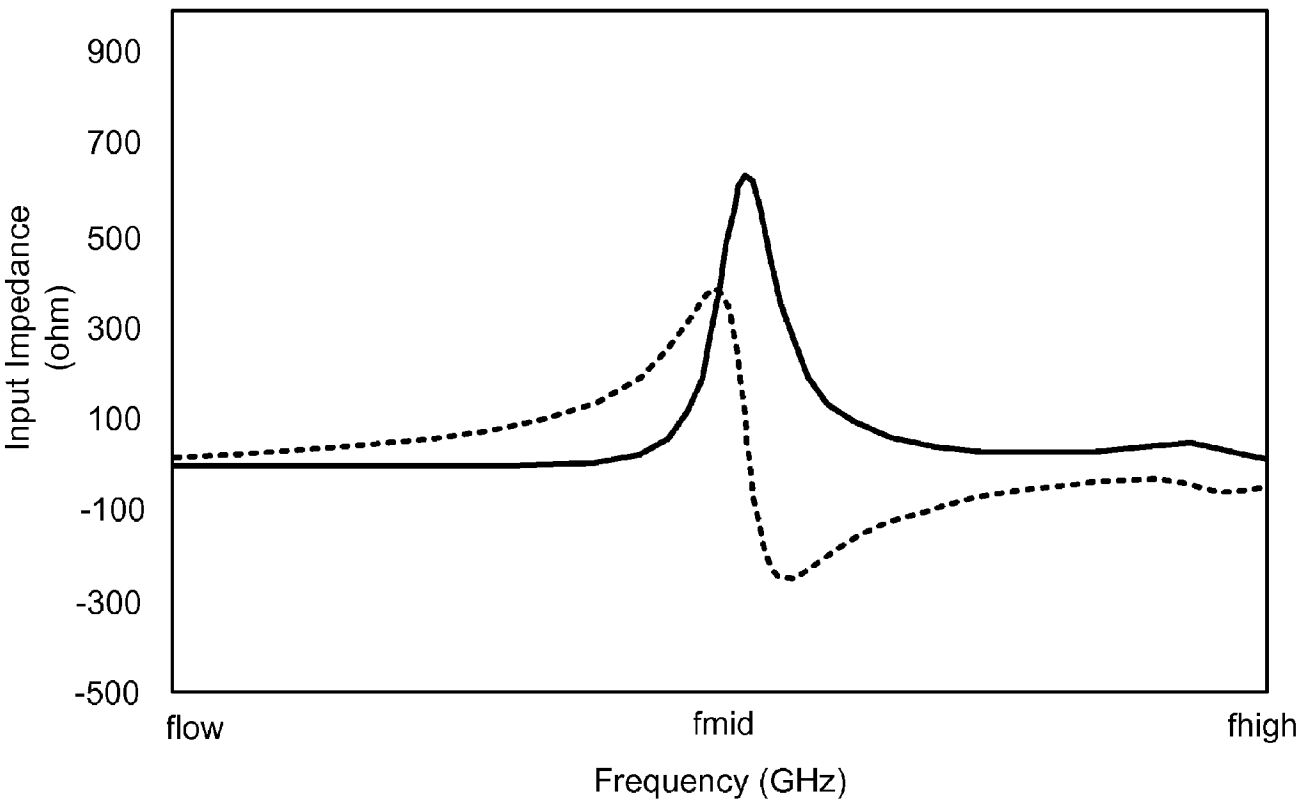

FIGS. 19 and 20 illustrate the simulated return loss and real and imaginary parts of the input impedance of the slot antenna device 1700, respectively. For example, the return loss indicates that the operational frequency is at 3.19 GHz. The impedance plot indicates that the antenna resonant frequency is at 3.27 GHz. The resonance frequency in the RH region for the second slot antenna device 1700 may be determined by similar parameters presented in the previous design such as the series inductance $L_R$ and the shunt capacitance $C_R$. In FIGS. 19 and 20, an increase in antenna frequency can be observed in the second slot antenna device 1700, a 2× shift over the previous design, as induced by the additional series capacitance $C_L$ formed by the coupling gap 1725.

Figure 21B:
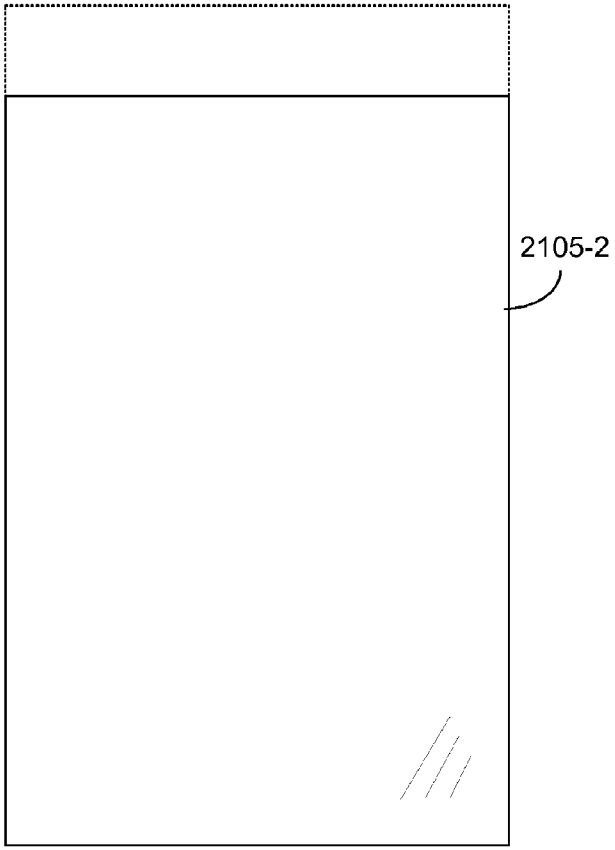
FIGS. 21A-21C illustrate multiple views of a third slot antenna device, according to an example embodiment.
Figure 21A:
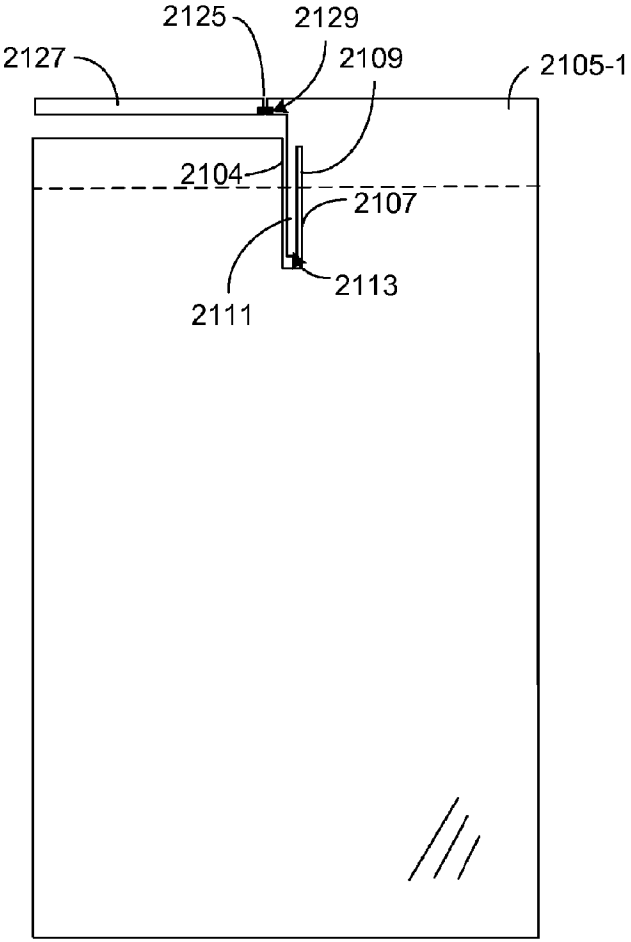
Figure 21C:
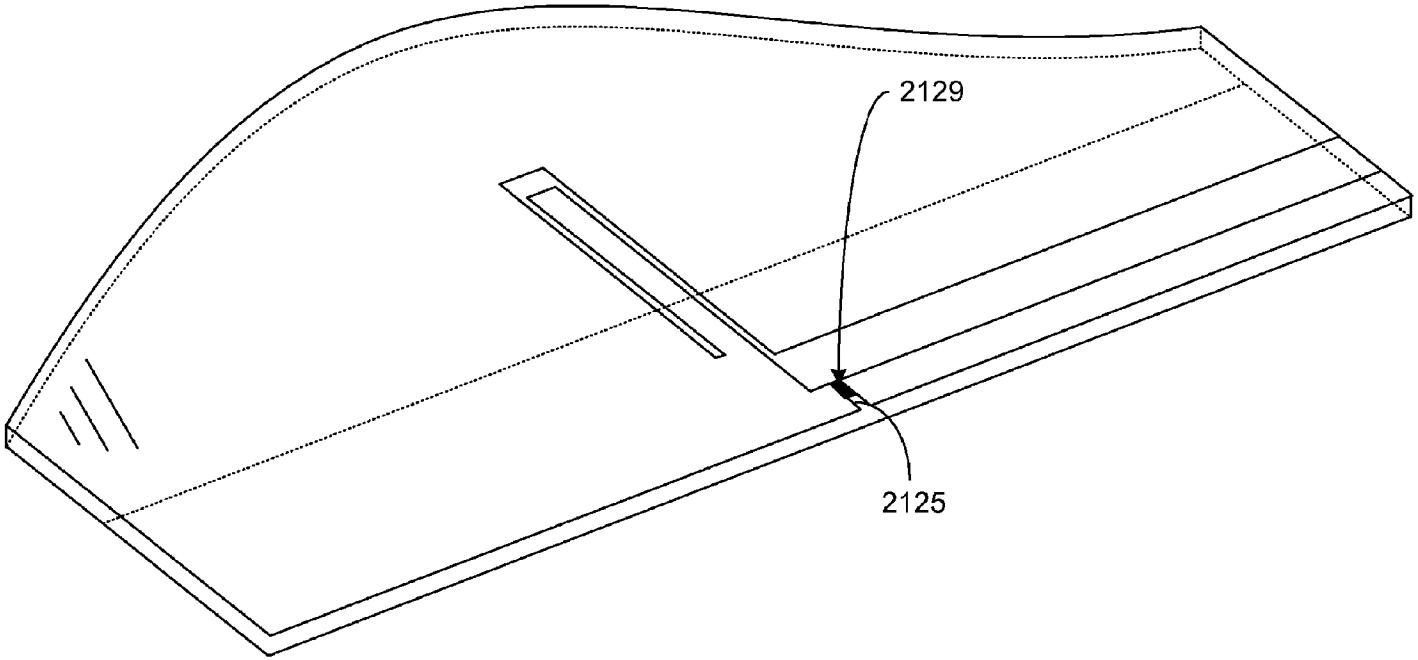

FIGS. 21A-21C respectively illustrate a top view of a top layer 2100-1, a top view of a bottom layer 2100-2, and an isometric view of a third slot antenna device 2100, according to an example embodiment. The third slot antenna device 2100 is fundamentally similar to that of the second slot antenna device 1700, except that a discrete RF component, such as a lumped capacitor 2129, is mounted across the coupling gap 2125 in the first layer 2100-1 to capacitively couple a top ground 2105-1 to a metal plate 2127 as shown in FIG. 21A. This additional capacitance provided by the lumped capacitor 2129 may electrically increase the series capacitance $C_L$ formed by the coupling gap 2125 and thus tune the antenna to a desirable frequency level.

Since the size, shape and structure of the third slot antenna device 2100 are fundamentally similar to the previous slot antenna device 1700, several design parameters and features of the second slot antenna device 1700 may directly apply to the third slot antenna device 2100. A full description of these design parameters are provided in the previous example.

The third slot antenna device 2100 may be activated by connecting an RF source to a CPW feed port 2113 and the antenna ground 2105-1 to excite the slot antenna device 2100. A series inductance $L_R$, a shunt capacitance $C_R$, a series capacitance $C_L$, and a series capacitance $C_1$ may be induced along the conductive edges formed by the adjoining openings and by a current flow provided by the RF source. The structural element defining the series inductance $L_R$ and a shunt capacitance $C_R$ of the third antenna device 2100 are similar to the second antenna device 1700. For example, structural elements defining the inductance $L_R$ may include one side of a CPW feed 2111 and a conductive edge adjacent to the upper side of an antenna slot 2103, as indicated by the bold dashed line 2201 shown in FIG. 22A. The shunt capacitance $C_R$ may be determined by the gap formed between two conductive plates 2203 and 2205, defining an antenna slot 2103 in the top conductive layer 2100-1. In this example, the total series capacitance may include $C_L$ and $C_1$ where $C_L$ is generated by the coupling gap 2125, and $C_1$ is attributed to the lumped capacitor 2129 as shown in FIG. 22A.

Figure 22B:
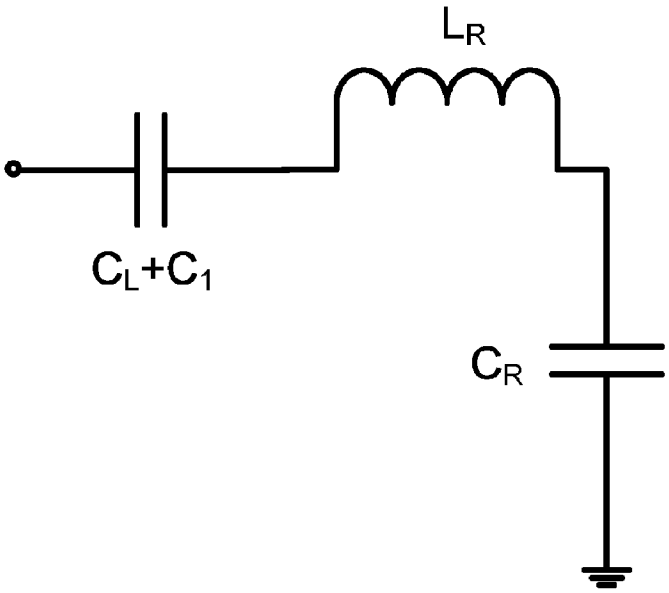
FIG. 22B illustrates an equivalent circuit model of the third slot antenna device shown in FIGS. 21A-21C, according to an example embodiment.
Figure 22A:
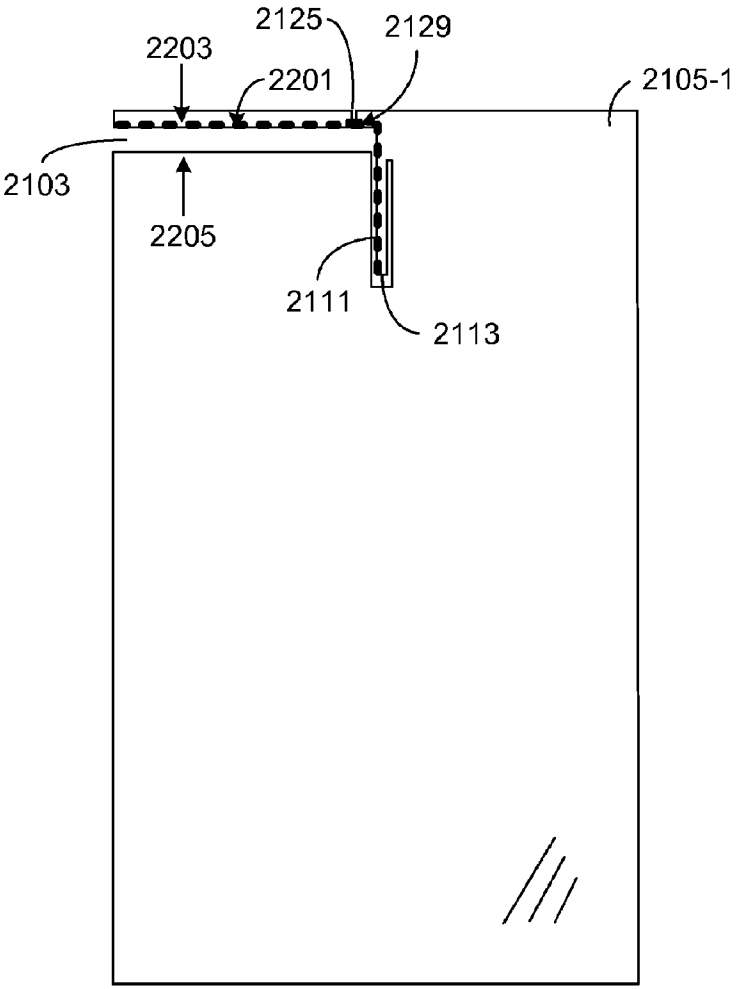
FIG. 22A illustrates structural elements defining certain inductance and capacitive elements of the third slot antenna device of FIGS. 21A-21C, according to an example embodiment.

FIG. 22B illustrates an equivalent circuit model of the third slot antenna device 2100 shown in FIGS. 21A-21C. The equivalent circuit model contains a series inductor $L_R$, a shunt capacitor $C_R$ and series capacitors ($C_L$+$C_1$) corresponding to the inductance and the capacitances defined by conductive sections forming the antenna slot section 2103, the connecting slot section 2104, the CPW slot section 2107, the coupling gap 2125, and including the lumped capacitor 2129 element.

Figure 23:
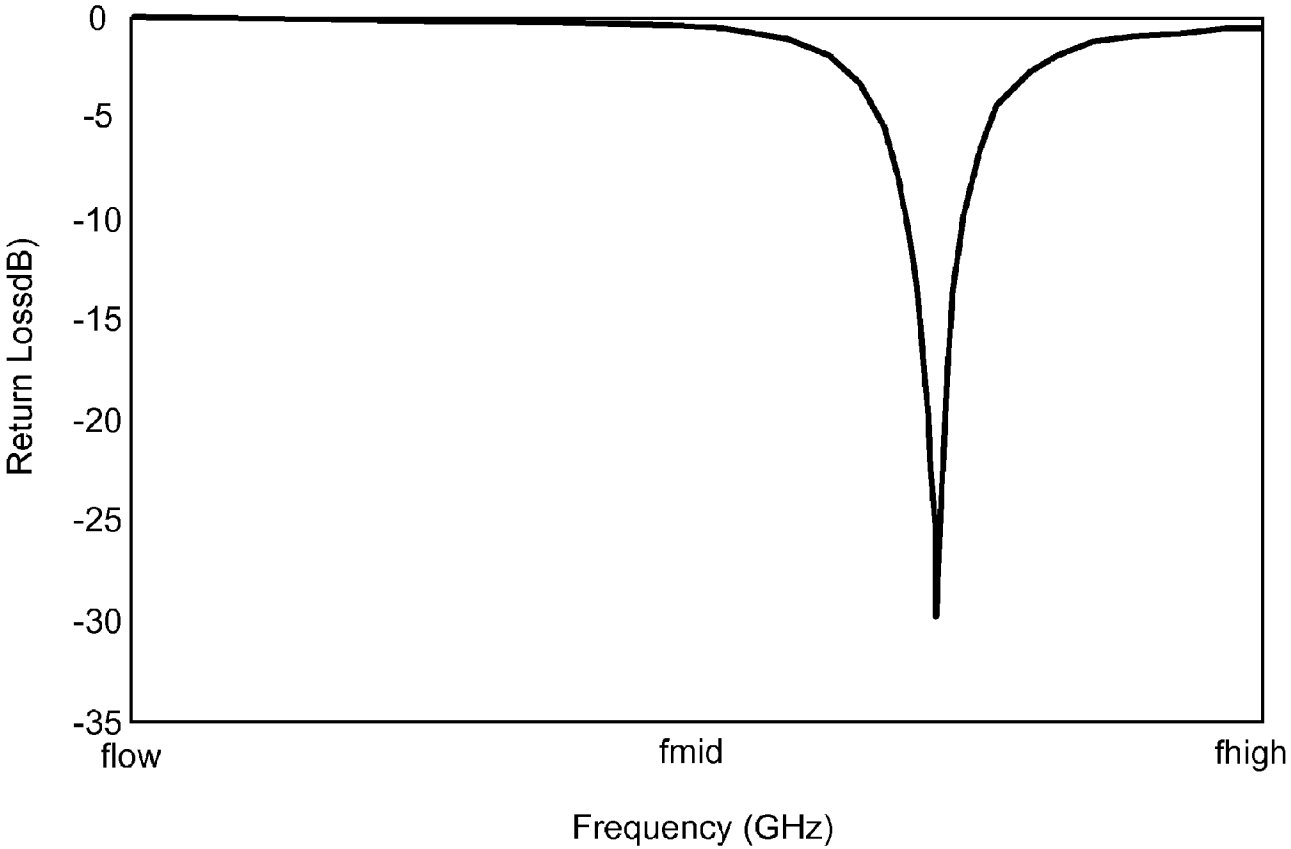
FIGS. 23 and 24 illustrate the simulated return loss and real and imaginary parts of the input impedance of the third slot antenna device, respectively.
Figure 24:
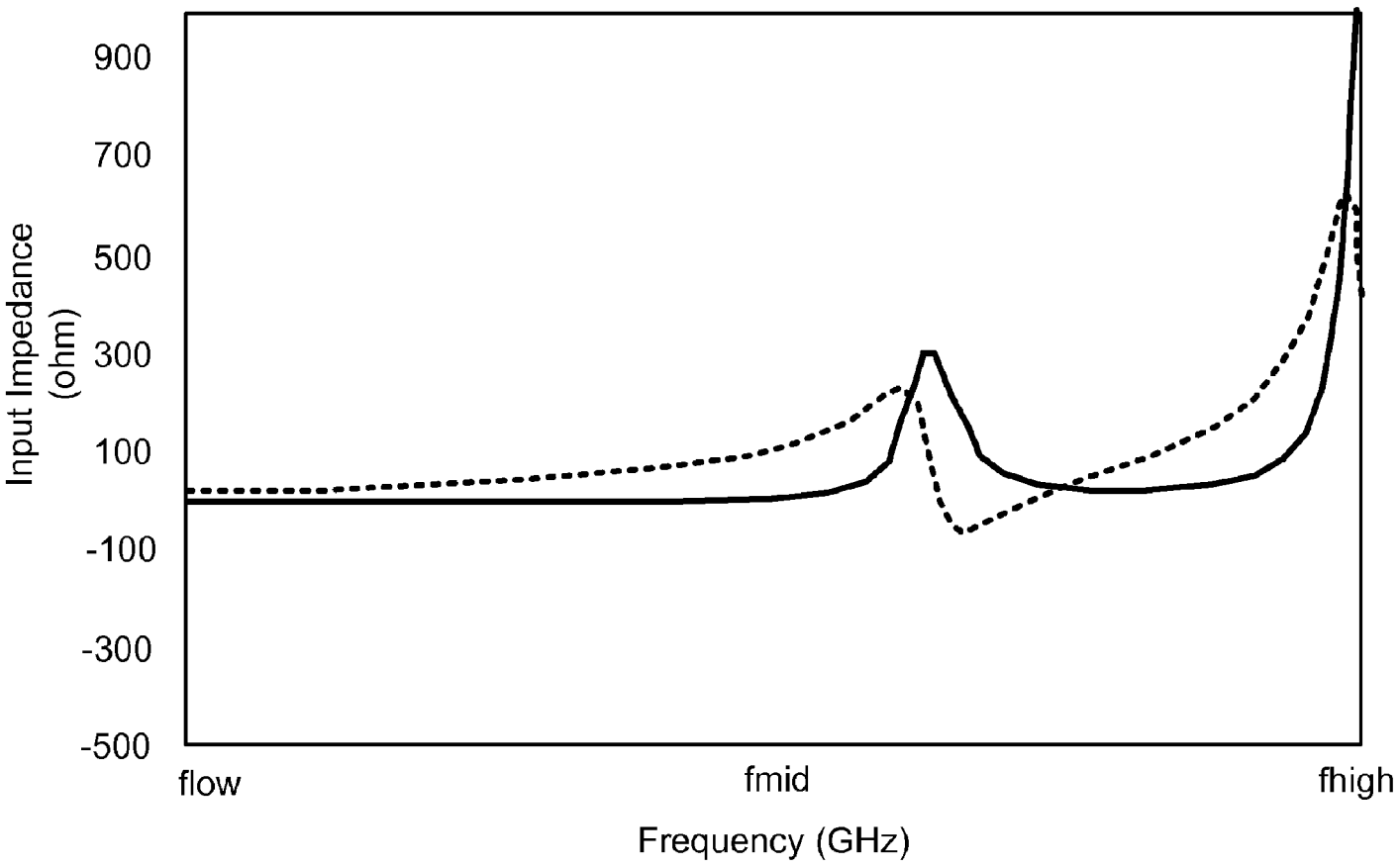

FIGS. 23 and 24 illustrate the simulated return loss and real and imaginary parts of the input impedance of the slot antenna device 2100, respectively. For instance, the return loss indicates the antenna operational frequency which is at 1.9 GHz. The impedance plot indicates the antenna resonance is at 1.78 GHz. For a given capacitance $C_1$, these results indicate at least a 40% decrease in the operational and antenna resonance frequencies as compared to the previous antenna device 1700. Furthermore, other capacitance values of the lumped capacitor 2129 may be chosen, as demonstrated in the third slot antenna device 2100, as to tune the antenna to a desired frequency.

The slot antenna devices presented thus far have been shown to support a resonance frequency primarily in the RH region, as primarily determined by the series inductance $L_R$ and the shunt capacitance $C_R$. However, the slot antenna device may also be configured as a CRLH antenna structure and thus support a second lower resonance frequency in the LH region. One way of creating a CRLH slot antenna structure is to load the original slot antenna with series capacitor CL and shunt inductor LL, or multiple CLs and LLs to create more than one LH resonance. While the examples provided use the upper surface of the dielectric circuit, each section of the CRLH slot antenna may be positioned at different levels creating a three dimensional (3D) structure.

Figures 25A, 25B:
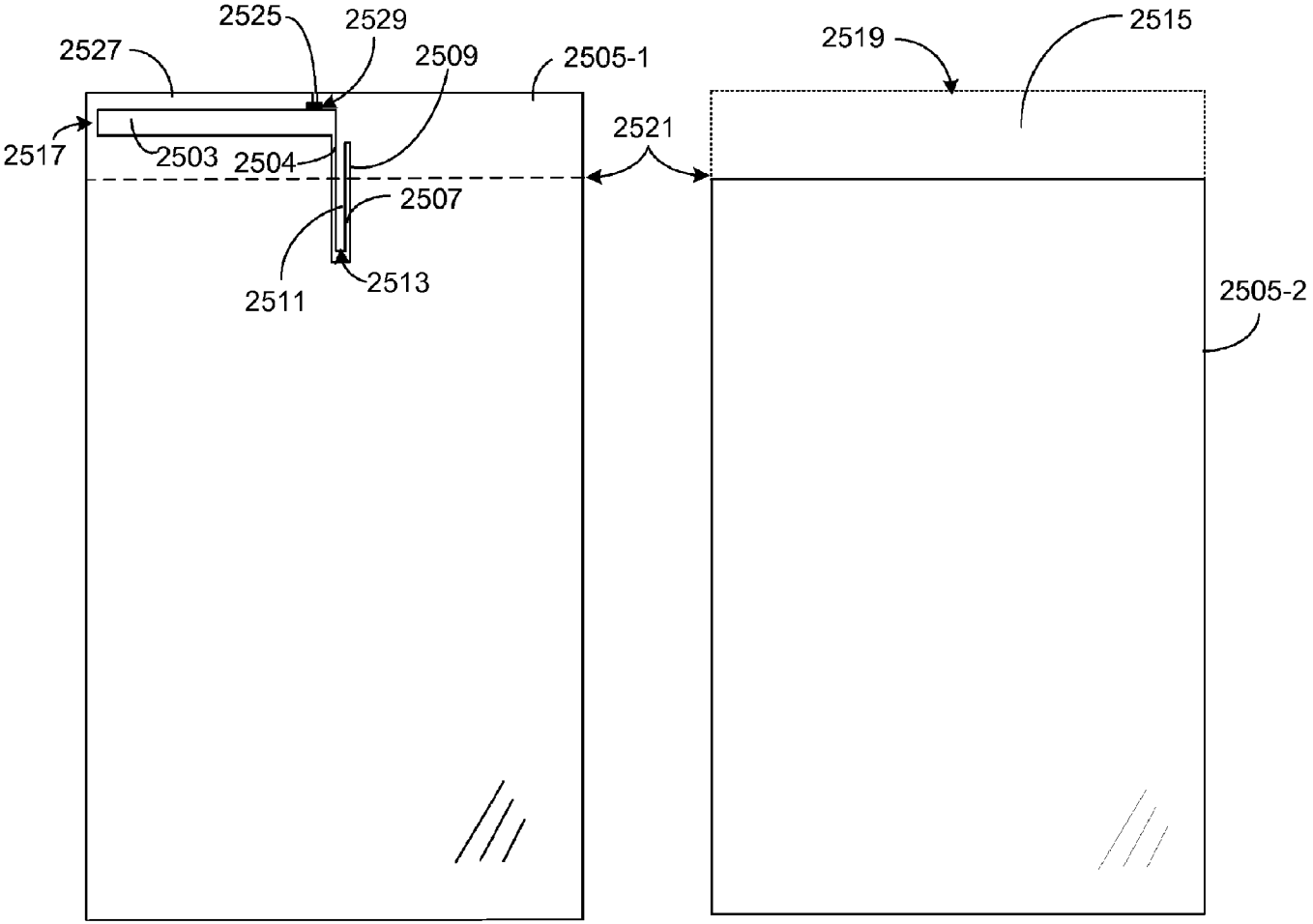
FIGS. 25A-25C illustrate a metamaterial slot antenna device, according to an example embodiment.
Figure 25C:
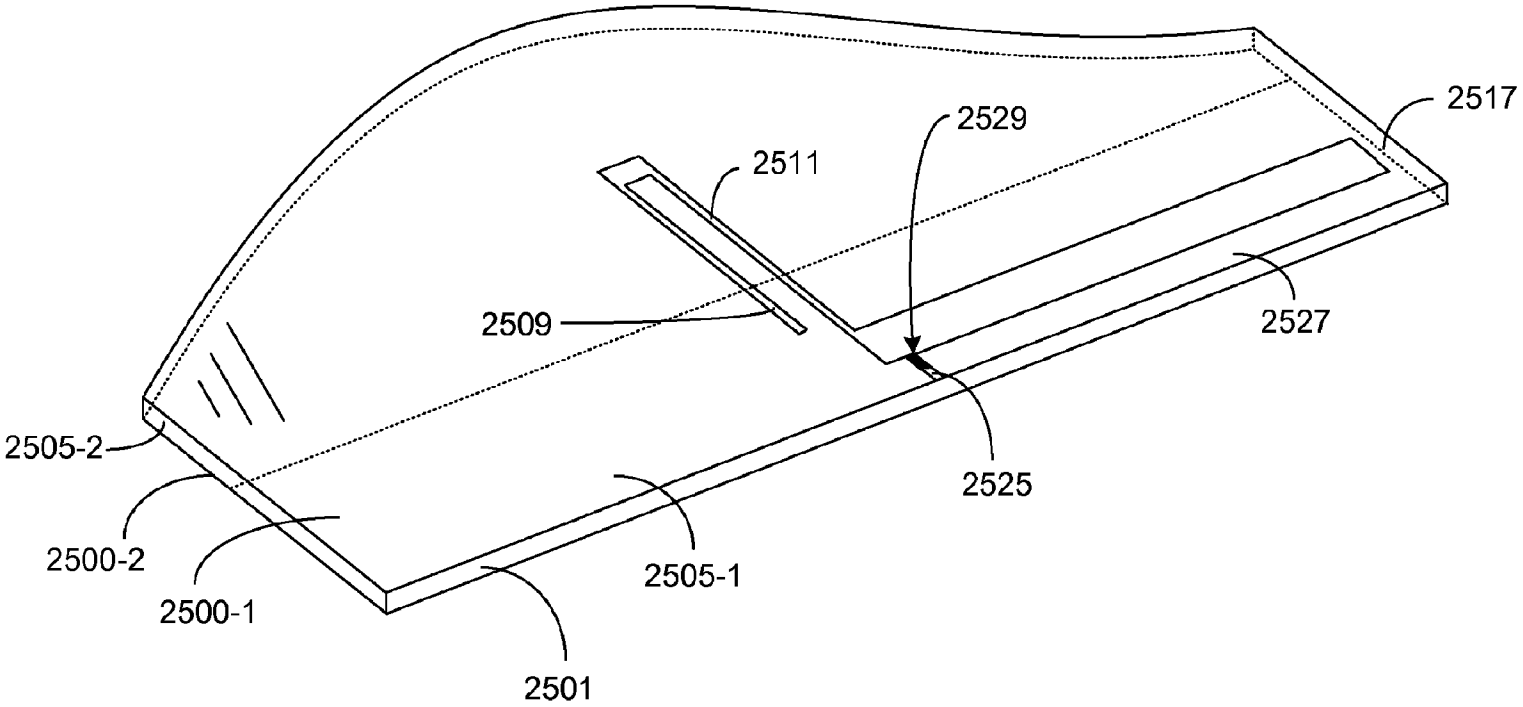

FIGS. 25A-25C illustrate a metamaterial slot antenna device 2500, according to an example embodiment. FIGS. 25A-25B represent a top view of a top conductive layer 2500-1 and a top view of a bottom conductive layer 2500-2, respectively. Structurally, the design of the second slot antenna device 2500 is fundamentally similar to the slot antenna device 2100 presented previously. However, modifications to the previous slot antenna design 2100 have been made to construct CRLH antenna structures, forming a metamaterial slot antenna device 2500.

In FIG. 25A, a top conductive layer 2500-1 of the metamaterial slot antenna device 2500 may be formed on a first surface of a substrate 2501. Examples of a conductive layer include a metal plate, a sheet of metal, or other conductive planes, having a boundary or perimeter defining a variety of shapes and sizes of the conductive layer. In addition, the boundary or perimeter may be defined by one or more straight or curved lines. Several adjoining openings, which expose the substrate 2501 and have different orientations and sizes, are formed at a distal end of the top conductive layer 2500-1 to form a contiguous slot. Openings may be formed in the substrate by selectively removing certain portions of the top conductive layer 2500-1 using various etching methods such as mechanical or wet etch systems. Sections of the contiguous slot may include an antenna slot section 2503, a connecting slot section 2504, a CPW slot section 2507, and a matching slot stub section 2509. Each slot sections 2503-2509 may be configured in different shapes including rectangles, triangles, circular or other polygon shapes. Furthermore, each slot sections may be positioned at different levels creating a three dimensional (3D) structure. In this example, each slot sections 2503-2509 are configured to be rectangular in shape or a combination of rectangular shapes, but vary in orientation and size. For instance, relative to one side of the substrate, the orientation of each rectangular shaped slot section 2503-2509 includes, but is not limited to, vertically or horizontally oriented openings. Other possible orientations include openings formed at any angle, ranging between 0° and 360°. Features of the contiguous aperture may be described in terms of its various slot sections 2503-2509. For example, the antenna slot section 2503 may be defined by forming an opening in the top conductive layer 2500-1, with the opening having one end that is adjacent to a closed end 2517, located at a distal end of the top conductive layer 2500-1, and another portion adjacent to a top ground 2505-1. A second rectangular opening forms the connecting slot section 2504 which connects the antenna slot section 2503 to one end of the CPW slot section 2507, including multiple adjoining rectangular openings that form a U-shape structure. The other end of the CPW slot 2507 is connected to a free end of a rectangular opening that forms a matching slot stub section 2509, having a closed end formed in the top ground 2505-1. The contiguous slot may also include a coupling gap 2525 which is formed in the top conductive layer 2500-1, separating one end of a metal plate 2527 from the top ground 2505-1. A lumped capacitor 2529 is mounted across the coupling gap 2525 in the top conductive layer 2500-1 to capacitively couple the top ground 2505-1 to the metal plate 2527 as shown in FIG. 25A.

In FIG. 25B, the bottom conductive layer 2500-2 of the metamaterial slot antenna device 2500 may be formed on a second surface of the substrate 2501. Certain sections of the contiguous slot may be projected above the bottom conductive layer 2500-2 such as a bottom ground 2505-2, while other sections may be projected above a clear-out section 2515 formed in the bottom conductive layer 2500-2 as shown in FIG. 17B. The clear-out section 2515 may be formed by etch methods described above starting along an edge 2519 of the substrate 2501 and extending to another edge 2521.

Referring again to FIG. 25A, sections of the contiguous slot that are projected above the clear-out section 2515 include the antenna slot section 2503, the connection slot section 2504, and the matching slot stub section 2509. The section of the contiguous slot that is projected below the clear-out section 2515 includes the CPW slot section 2507. The top and bottom grounds 2505-1 and 2505-2 may be connected together by an array of vias (not shown) formed in the substrate to form an extended ground plane.

Referring to the top conductive layer 2500-1 in FIG. 25A, a portion of a metal conductive strip isolated by the CPW slot section 2507 defines a grounded coplanar waveguide (CPW) feed 2511. In this example, one end portion of the CPW feed 2511 may be coupled to a top ground 2505-1 while the other end portion may be coupled to an RF signal port 2513.

Several design parameters and features of the second slot antenna device 2500 can be used in designing the antenna to achieve certain antenna properties for specific applications. Some examples are provided below.

The substrate 2501 may measure, for example, 100 mm×60 mm×1 mm (length×width×thickness) and may include dielectric materials such as FR-4, FR-1, CEM-1 or CEM-3. These materials may have a dielectric constant measuring approximately 4.4, for example.

The dimension of the CPW feed 2511 may be designed to measure about 1.4 mm×8 mm with 0.4 mm gap on each side. The dimension of the antenna slot section 2503 may be designed to measure about 3.00 mm×29.05 mm. The dimension of the connection slot section 2504 may be designed to measure about 0.4 mm×6.0 mm. The matching slot stub 2509 may be formed in proximity to the top ground 2505-1 where the matching slot stub 2509 is shorted to the top ground 2505-1 at 5 mm away from the top edge 2519 of the top ground 2505-1. In this implementation, the dimension of the coupling gap 2525 measures about 0.5 mm×2 mm and is located at about 1.05 mm away from the distal end of the antenna slot section 2503. The dimension of the clear-out section 2515 may be designed to measure about 11 mm×60 mm. The CPW feed 2511 may be designed to accommodate various impedances including, for example, 50 Ω.

In FIG. 25C, an isometric view of the metamaterial antenna slot device 2500 is presented and illustrates the stacking orientation of the top conductive layer 2500-1, substrate 2501, and bottom conductive layer 2500-2. Various elements presented in FIGS. 25A-25B, such as the slot, CPW feed and ground of the top and bottom layers, are presented in the isometric view shown in FIG. 25C.

To operate the metamaterial slot antenna device 2500, an RF source may be fed to the CPW feed port 2513 and the antenna ground 2505 to excite the slot antenna device 2500. A series inductance $L_R$ a shunt capacitance $C_R$, a shunt inductance $L_L$ and a series capacitance $C_L$ may be induced along the conductive edges formed by the adjoining openings and by a current flow provided by the RF source. Structural elements defining the inductance $L_R$ may include one side of the CPW feed 2511 and a conductive edge adjacent to the upper side of the antenna slot 2503, as indicated by the bold dashed line 2601 shown in FIG. 26A. The shunt capacitance $C_R$ may be determined by the gap formed between two conductive plates 2603 and 2605, defining the antenna slot 2503 in the top conductive layer 2500-1. In this example, a series capacitance may include $C_L$ and $C_1$ where $C_L$ is generated by the coupling gap 2525 and $C_1$ is attributed to the lumped capacitor 2529 as shown in FIG. 25A. A shunt inductance $L_L$ may be formed by the additional current flow at the left closed end 2517 of the antenna slot device 2500, as indicated by the bold dotted line 2602.

Figure 26B:
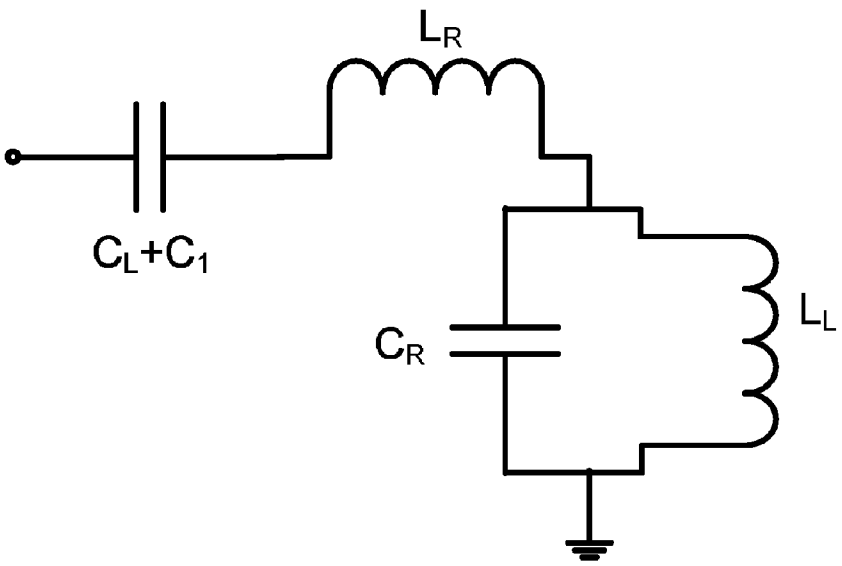
FIG. 26B illustrates an equivalent circuit model of the metamaterial slot antenna device shown in FIGS. 25A-25C, according to an example embodiment.
Figure 26A:
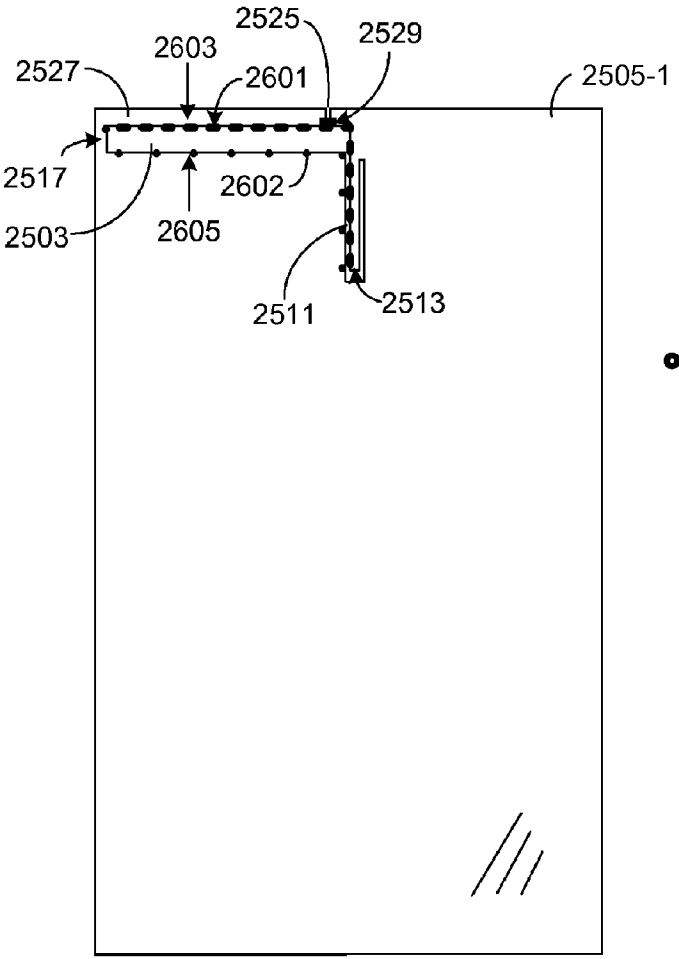
FIG. 26A illustrates structural elements defining certain inductance and capacitive elements of the metamaterial slot antenna device of FIGS. 25A-25C, according to an example embodiment.

FIG. 26B illustrates an equivalent circuit model of the metamaterial slot antenna device 2500 shown in FIGS. 25A-25C. Though structurally discernable, this equivalent circuit model represents a unit cell that is similar to the 1-dimensional (1D) CRLH MTM transmission line (TL) unit cell described in FIG. 3 and FIG. 9. For example, the CRLH parameters for the metamaterial slot antenna device 2500 may include a series inductor $L_R$ and a shunt capacitor $C_R$ corresponding to the inductance and the capacitance defined by conductive sections forming the antenna slot section 2503, the connecting slot section 2504, and the CPW slot section 2507. Furthermore, the CRLH parameters for the metamaterial slot antenna device 2500 may also include a shunt inductor $L_L$, as induced by the additional current flow at the left closed end of the antenna slot, and series capacitors ($C_L$ and $C_1$), where $C_L$ is generated by the coupling gap 2525 and $C_1$ is attributed to the lumped capacitor 2529.

The metamaterial slot antenna device 2500 may include multiple resonance frequencies defined by the CRLH antenna structures. For instance, the series inductance $L_R$ and the shunt capacitance $C_R$ may contribute to a resonance produced in the RH region while the shunt inductance $L_L$ and the series capacitance ($C_L$+$C_1$) may contribute to a resonance produced in the LH region. Simulation modeling tools, such as Ansoft HFSS, can be applied to the metamaterial slot antenna device 2500 for estimating operational frequency and other performance data, including return loss and impedance plots.

Figure 27:
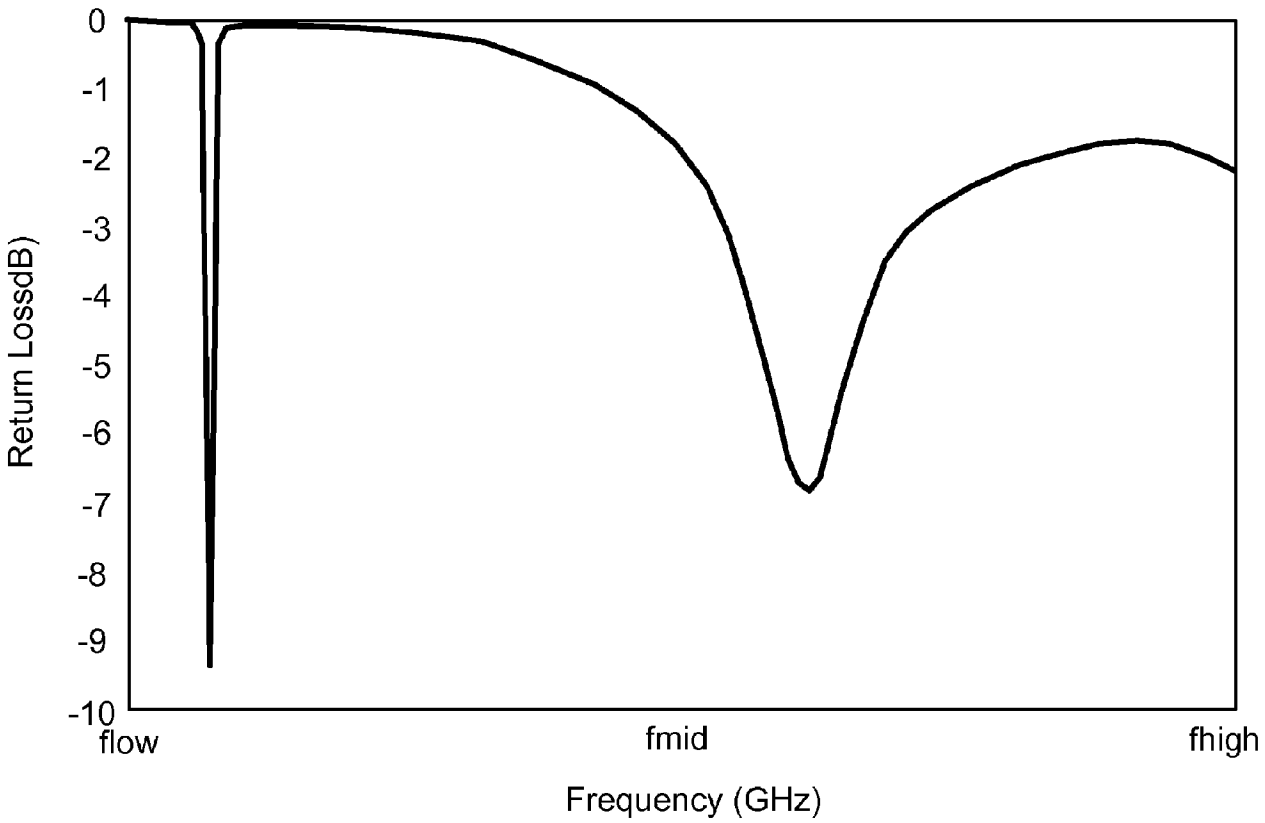
FIGS. 27 and 28 illustrate the simulated return loss and real and imaginary parts of the input impedance of the metamaterial slot antenna device, respectively, according to an example embodiment.
Figure 28:
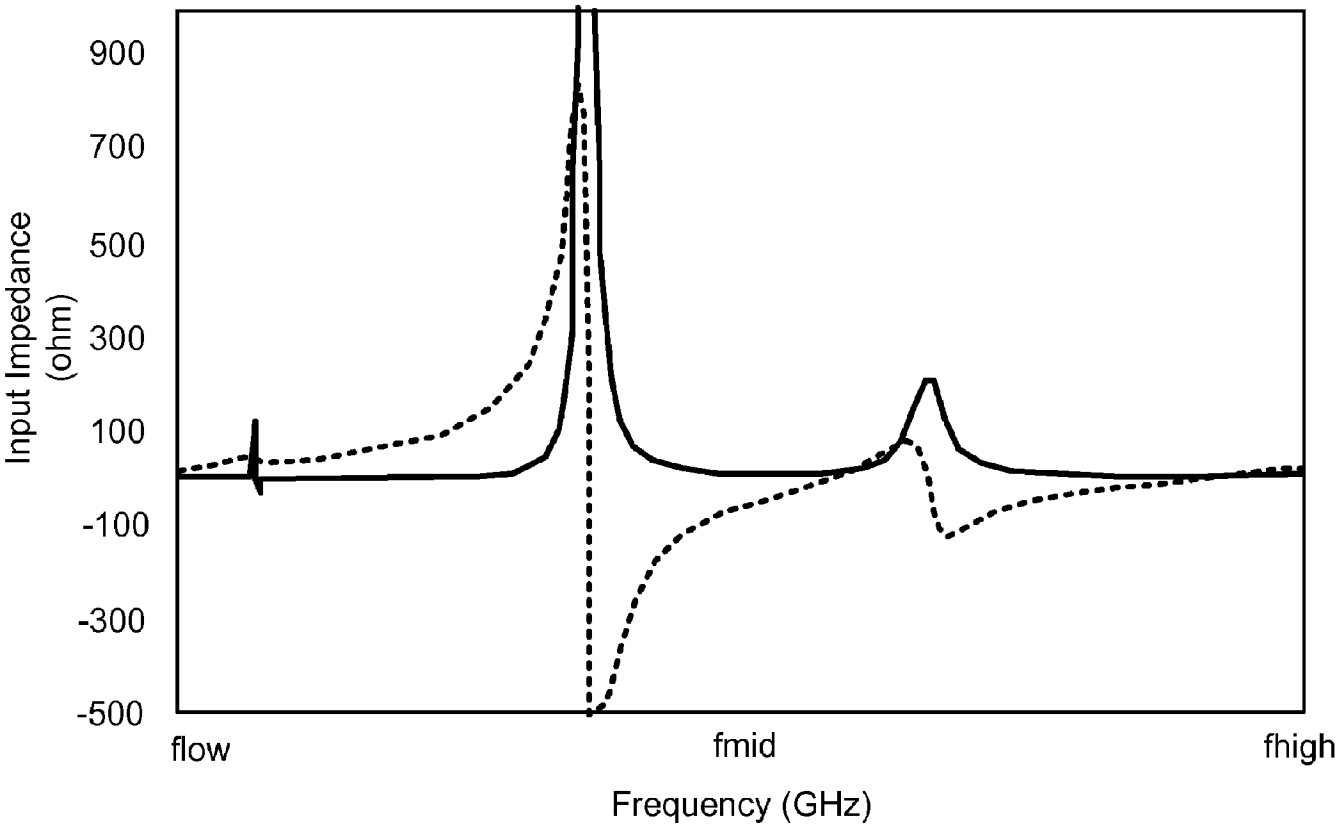

FIGS. 27 and 28 illustrate the simulated return loss and real and imaginary parts of the input impedance of the metamaterial slot antenna device 2500, respectively. In FIG. 27, the return loss plot indicates that the metamaterial slot antenna device 2500 operates at a frequency range of about 0.825 GHz and 3.26 GHz. The lower operational frequency may be attributed to the LH mode, and the higher operational frequency may be attributed to the RH mode. By comparison, the RH mode in the previous slot antenna devices is comparable to the RH mode for the metamaterial slot antenna device 2500 due to structural and electrical similarities between these slot antenna devices.

The operational frequency may also be extrapolated from FIG. 28, showing both real and imaginary parts of the input impedance of the metamaterial slot antenna device 2500. The RH and LH antenna resonances in this figure are approximately at 0.82 GHz and 3.495 GHz, respectively, which are similar to the frequencies obtained in the return loss plot in FIG. 27.

Further tuning and performance enhancements of the metamaterial slot antenna device 2500 may be possible through structural modifications of certain antenna elements.

Figure 29B:
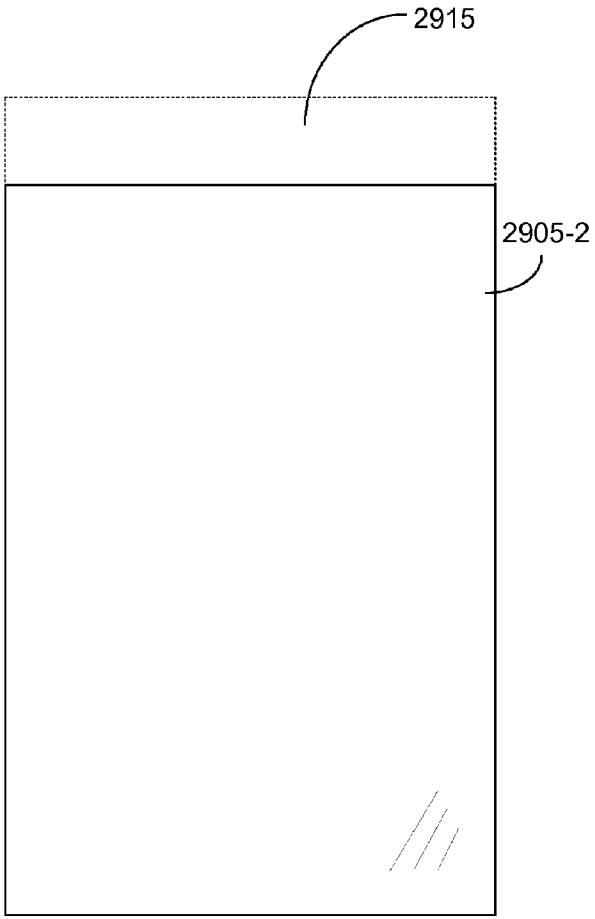
FIGS. 29A-29C illustrate a modified version of the metamaterial slot antenna device shown in FIGS. 25A-25C, which is referred to herein as MTM-B1 slot antenna device, according to an example embodiment.
Figure 29A:
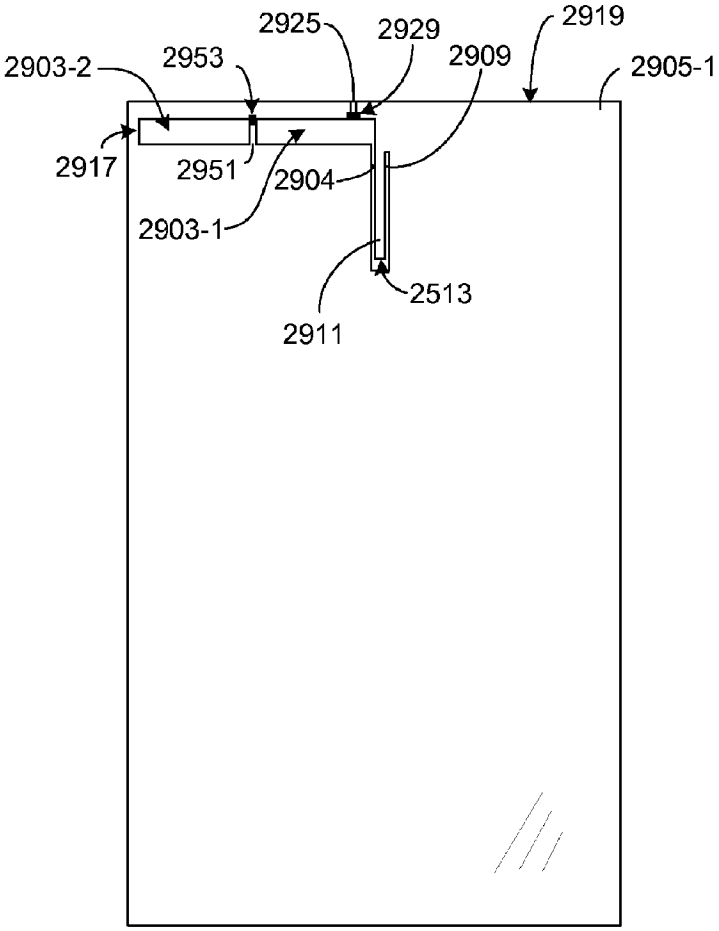
Figure 29C:
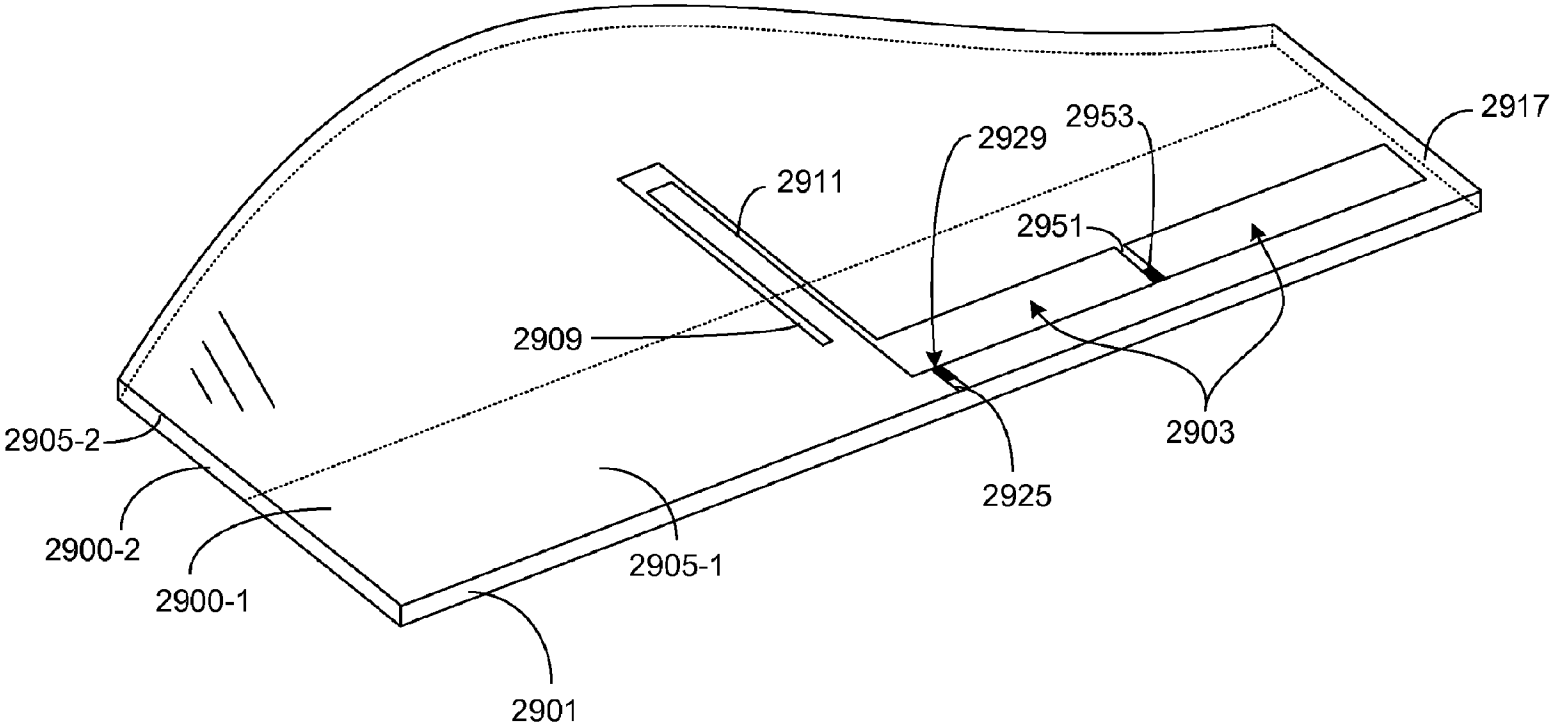

FIGS. 29A-29C illustrate a modified version of the metamaterial slot antenna device 2500, which is referred to herein as MTM-B1 slot antenna device 2900. FIGS. 29A-29C respectively illustrate a top view of a top layer 2900-1, a top view of a bottom layer 2900-2, and an isometric view of a slot antenna device 2900, according to an example embodiment. In both form and function, the MTM-B1 slot antenna device 2900 is fundamentally similar to that of the metamaterial slot antenna device 2500, except that a conductive strip 2951 is included to separate the antenna slot 2903 into two portions, and a second lumped capacitor 2953 is connected between the separated portions of the antenna slot 2903, as shown in FIG. 29A. These additional structures, as shown in the ensuing simulation results, may further enhance and tune the metamaterial slot antenna device 2900.

Several design parameters and features of the second slot antenna device 2900 may be used in designing the antenna to achieve certain antenna properties for specific applications. Some examples are provided below.

The substrate 2901 may measure, for example, 100 mm×60 mm×1 mm (length×width×thickness) and may include dielectric materials such as FR-4, FR-1, CEM-1 or CEM-3. These materials may have a dielectric constant measuring approximately 4.4, for example.

The dimension of the CPW feed 2911 may be designed to measure about 1.4 mm×8 mm with 0.4 mm gap on each side. The dimension of the antenna slot section 2903 may be designed to measure about 3.00 mm×29.05 mm. The conductive strip 2951 separating the antenna slot into two portions may measure about 2.5 mm×0.5 mm. The dimension of the connection slot section 2904 may be designed to measure about 0.4 mm×6.0 mm. The matching slot stub 2909 may be formed in proximity to the top ground 2905-1 where the matching slot stub 2909 is shorted to the top ground 2905-1 at 5 mm away from the top edge 2919 of the top ground 2905-1. In this implementation, the dimension of the coupling gap 2925 measures about 0.5 mm×2 mm and is located at about 1.05 mm away from the distal end of the antenna slot section 2903. The dimension of the clear-out section 2915 may be designed to measure about 11 mm×60 mm. The CPW feed 2911 may be designed to accommodate various impedances including, for example, 50 Ω.

In FIG. 29C, an isometric view of the MTM-B1 slot antenna device 2900 is presented and illustrates the stacking orientation of the top conductive layer 2900-1, substrate 2901, and bottom conductive layer 2900-2. Various elements presented in FIGS. 29A-29B, such as the slot, CPW feed and ground of the top and bottom layers, are presented in the isometric view shown in FIG. 29C.

The MTM-B1 slot antenna 2900 may be operated by connecting an RF source to the CPW feed port 2913 and the antenna ground 2905 to excite the MTM-B1 slot antenna 2900. A series inductance $L_R$ a shunt capacitance $C_R$, a shunt inductance $L_L$, and a series capacitance $C_L$ may be induced along the conductive edges formed by the adjoining openings and by a current flow provided by the RF source. Structural elements defining the inductance $L_R$ may include one side of the CPW feed 2911 and a conductive edge adjacent to the upper side of the antenna slot 2903, as indicated by the bold dashed line 3001 shown in FIG. 30A. The shunt capacitance may include $C_R$ and $C_2$ where $C_R$ is determined by the gap formed between two conductive plates 3003 and 3005, defining the right antenna slot 2903-1 in the top conductive layer 2900-1 and $C_2$ is attributed to the lumped capacitor 2953. In addition, a series capacitance may include $C_L$ and $C_1$ where $C_L$ is generated by the coupling gap 2925 and $C_1$ is attributed to the lumped capacitor 2929 as shown in FIG. 29A. A shunt inductance $L_L$ may be formed by the additional current flow at the left closed end 2917 of the antenna slot device 2900, as indicated by the bold dotted line 3002.

Figure 30B:
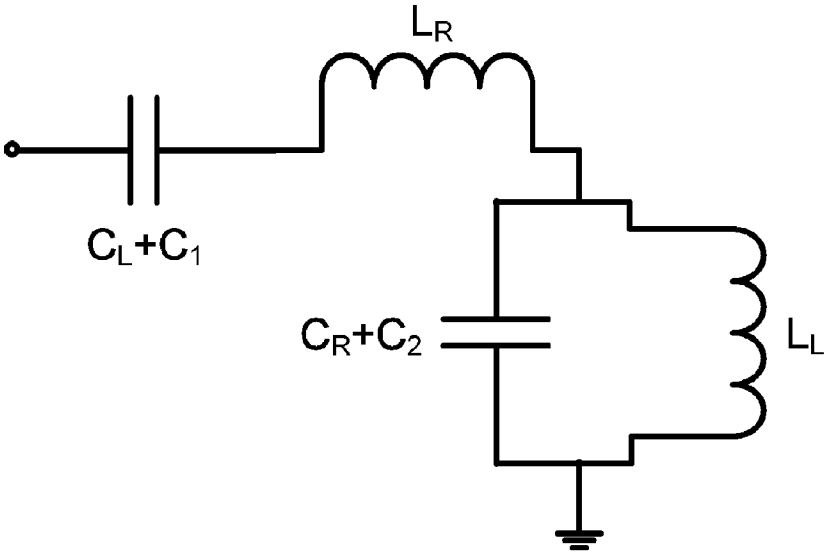
FIG. 30B illustrates an equivalent circuit model of the MTM-B1 slot antenna shown in FIGS. 29A-29C, according to an example embodiment.
Figure 30A:
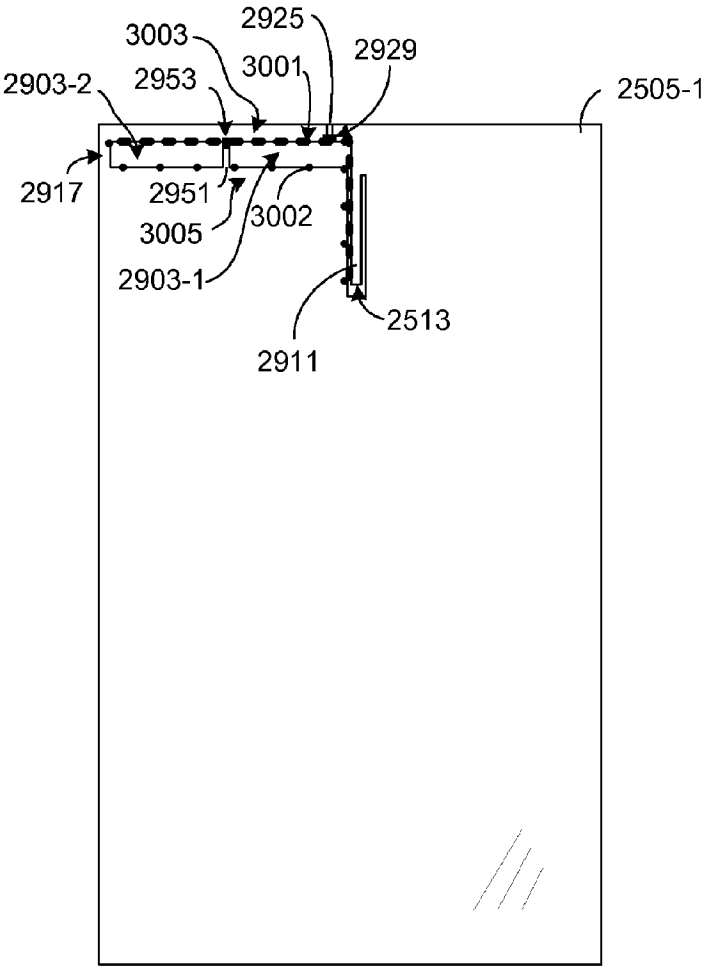
FIG. 30A illustrates structural elements defining certain inductance and capacitive elements of the MTM-B1 slot antenna shown in FIGS. 29A-29C, according to an example embodiment.

FIG. 30B illustrates an equivalent circuit model of the MTM-B1 slot antenna 2900 shown in FIGS. 29A-29C. The CRLH parameters for the MTM-B1 slot antenna 2900 may include a series inductor $L_R$ and a shunt capacitor $C_R$ corresponding to the inductance and the capacitance defined by conductive sections forming the antenna slot section 2903, the connecting slot section 2904, and the CPW slot section 2907. The shunt capacitance, in this example, may include capacitors ($C_R$ and $C_2$) where $C_R$ is generated by the upper side and lower side conductive plates 3003 and 3005 of the right antenna slot 2903-1, and $C_2$ is attributed to the lumped capacitor 2953. In addition, the CRLH parameters for the MTM-B1 slot antenna 2900 may also include a shunt inductor $L_L$, as induced by the additional current flow at the left closed end 2917 of the antenna slot 2903, and series capacitors ($C_L$ and $C_1$), where $C_L$ is generated by the coupling gap 2525 and $C_1$ is attributed to the lumped capacitor 2529. With respect to parts of the 1-dimensional (1D) CRLH MTM transmission line (TL) unit cell, the series capacitance ($C_L$+$C_1$) and shunt inductance ($L_L$) represent the LH portion of the unit cell, and the shunt capacitance ($C_R$+$C_2$) and series inductance ($L_R$) represent the RH portion of the unit cell.

Figure 31:
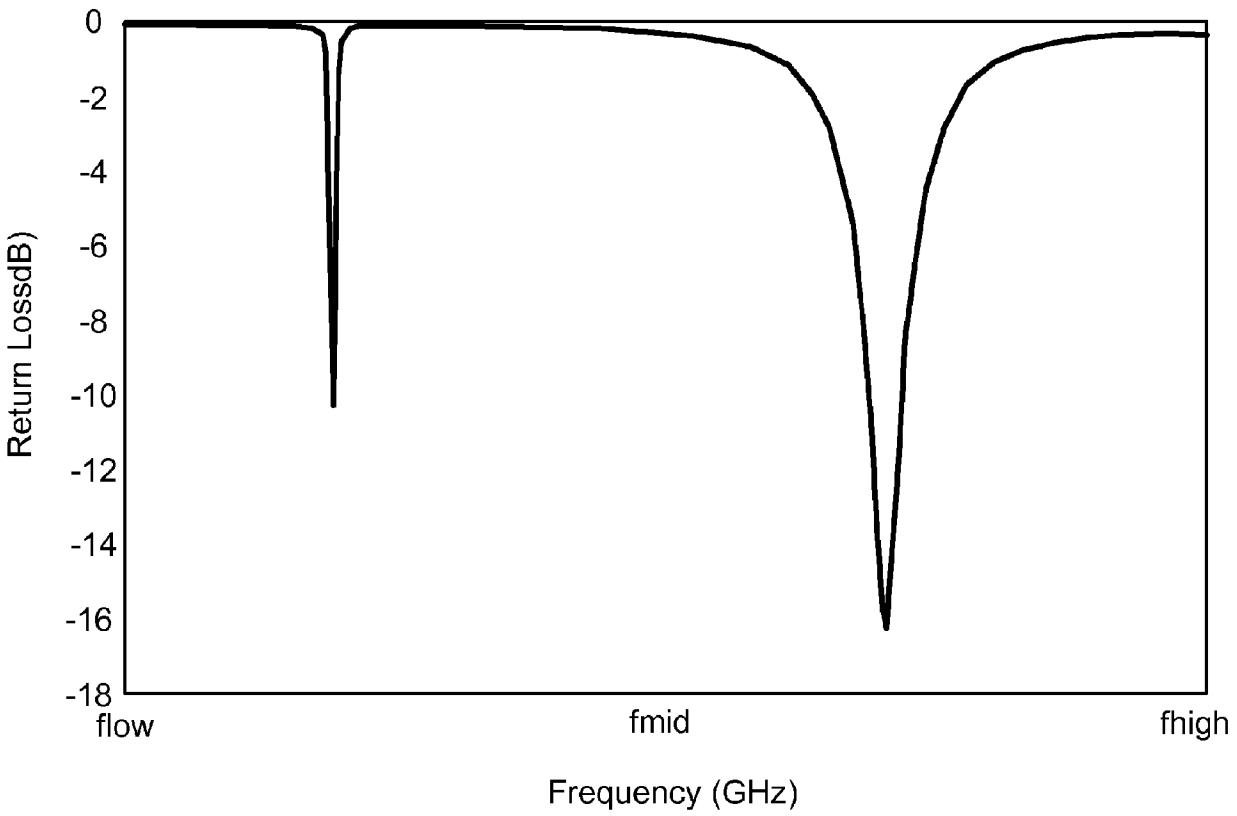
FIGS. 31 and 33 illustrate the simulated return loss, real and imaginary parts of the input impedance, and the efficiency plots of the MTM-B1 slot antenna 2900, respectively, according to an example embodiment.
Figure 33:
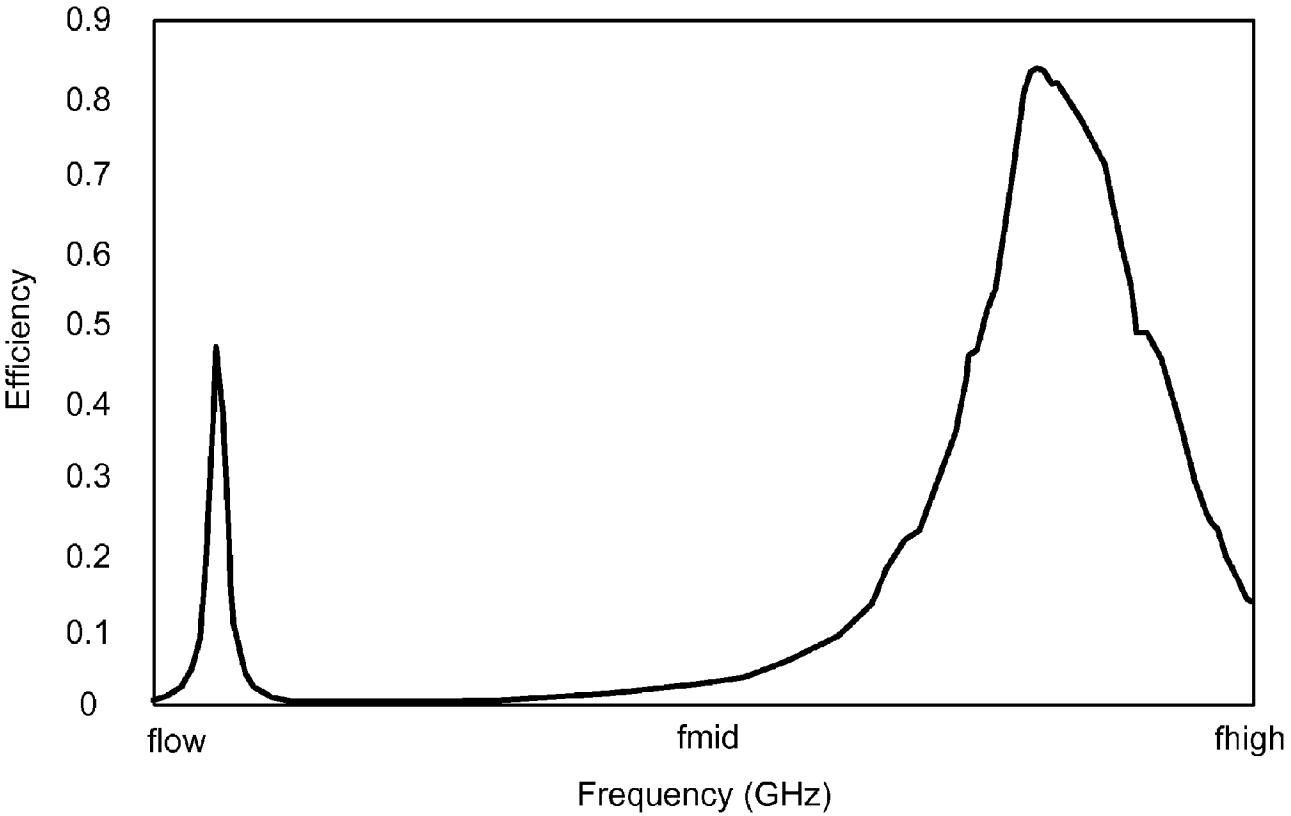

FIGS. 31 and 33 illustrate the simulated return loss, real and imaginary parts of the input impedance, and the efficiency plots of the MTM-B1 slot antenna 2900, respectively. In FIG. 31, the return loss plot indicates that the metamaterial slot antenna device 2900 operates at a frequency range of about 0.88 GHz and 1.9 GHz corresponding to the LH and RH modes, respectively. Compared to the simulated return loss shown in FIG. 25 of the previous example, the shift in the LH resonance appears negligible since the series capacitance ($C_L$+$C_1$) is the same in both examples. However, the RH resonance noticeably shifts from 3.26 GHz to 1.9 GHz due to the extra lumped capacitor $C_2$ in the MTM-B1 slot antenna device 2900.

Figure 32:
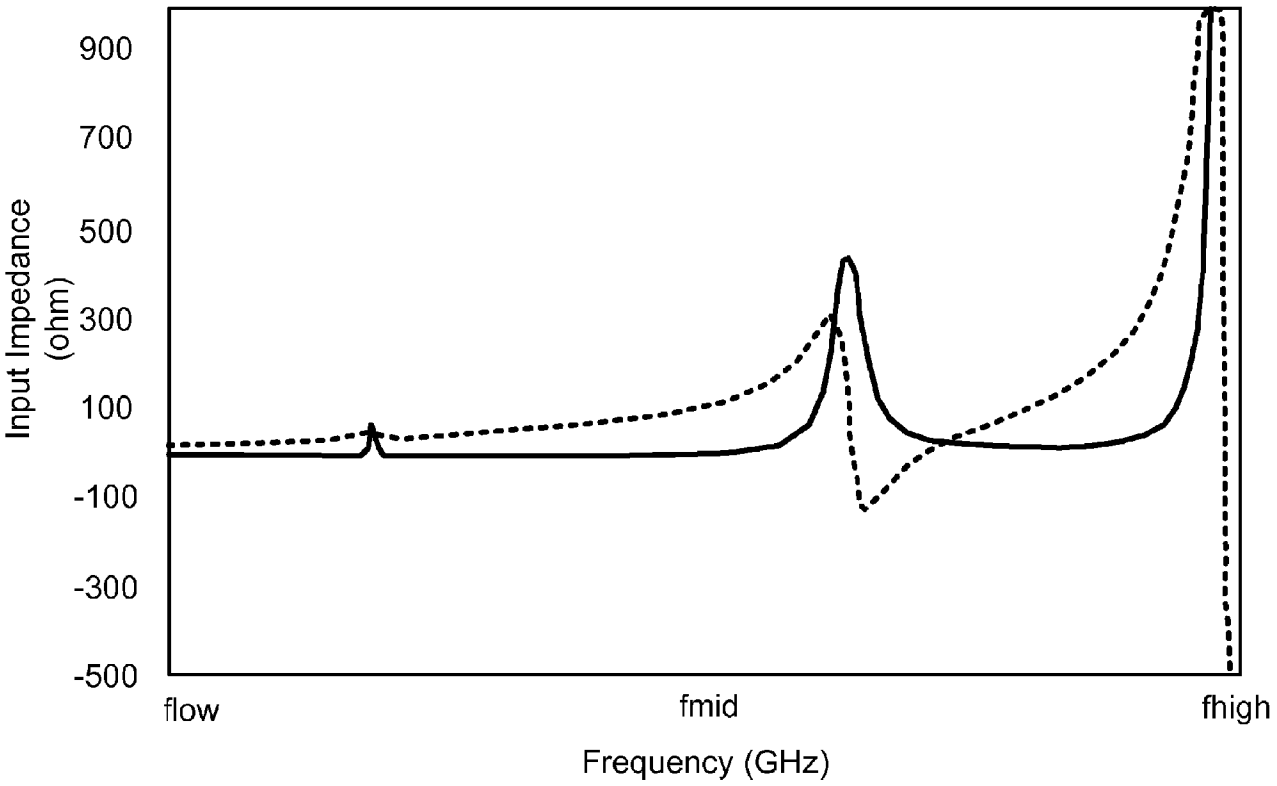

FIG. 32 illustrates both real and imaginary parts of the input impedance of the MTM-B1 slot antenna device 2900. The LH and RH antenna resonances are approximately at 0.88 GHz and 1.76 GHz, respectively, and comparable to the LH and RH resonances obtained in the simulated return loss plot.

FIG. 33 illustrates the measured radiation efficiency of the MTM-B1 slot antenna device 2900. The peak efficiencies at 0.88 GHz and 1.92 GHz are 50% and 81%, respectively, which indicate acceptable efficiency levels are possible at both resonances.

Overall, these results show that the LH and RH resonances can be respectively controlled by the $C_L+C_1$ and $C_R+C_2$ and that this design may offer suitable efficiency results in both the LH and RH regions.

Figure 34A:
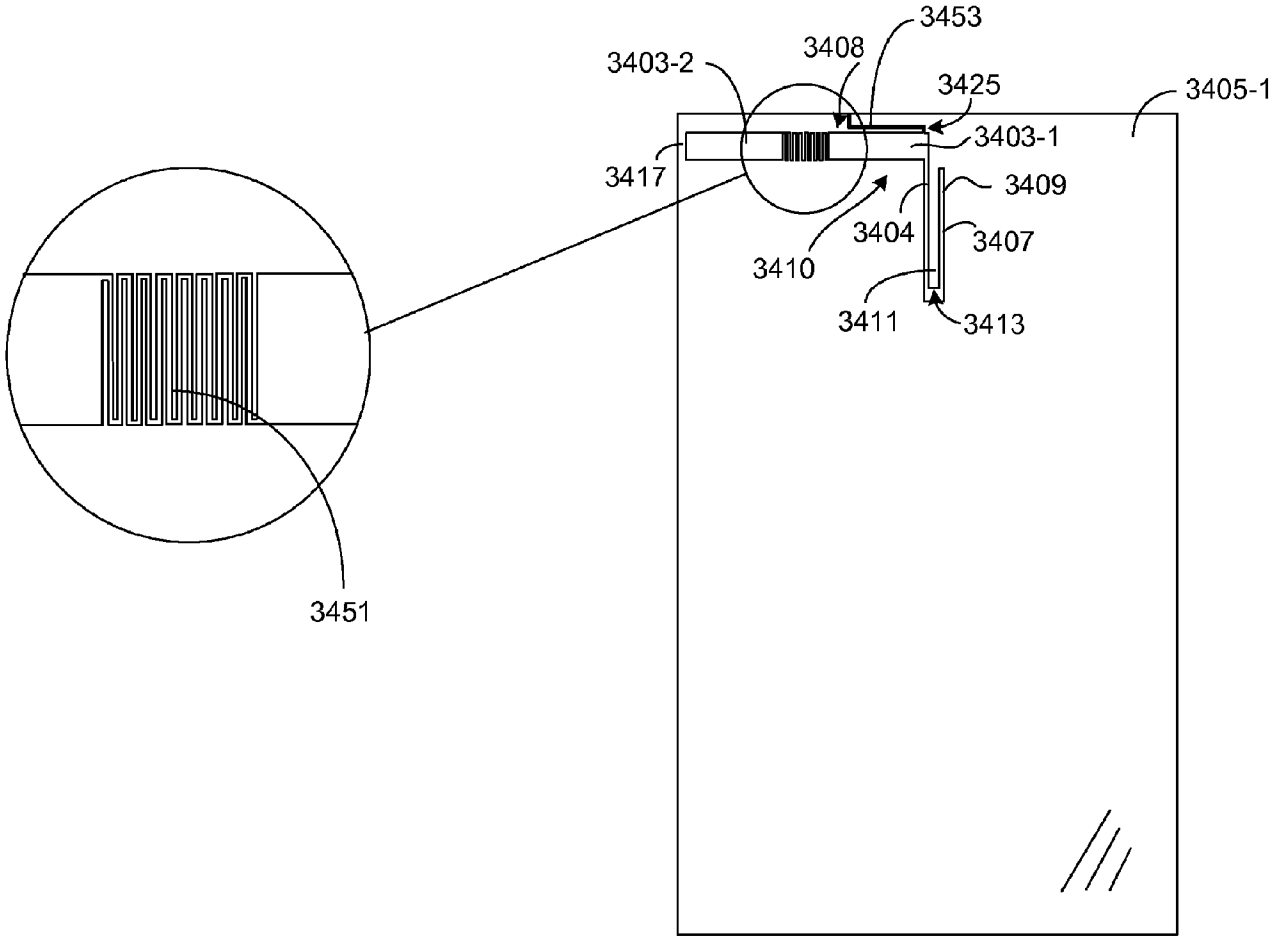
FIGS. 34A-34C illustrate a modified version of the MTM-B1 slot antenna device, which is referred to herein as MTM-B2 slot antenna device, according to an example embodiment.
Figure 34B:
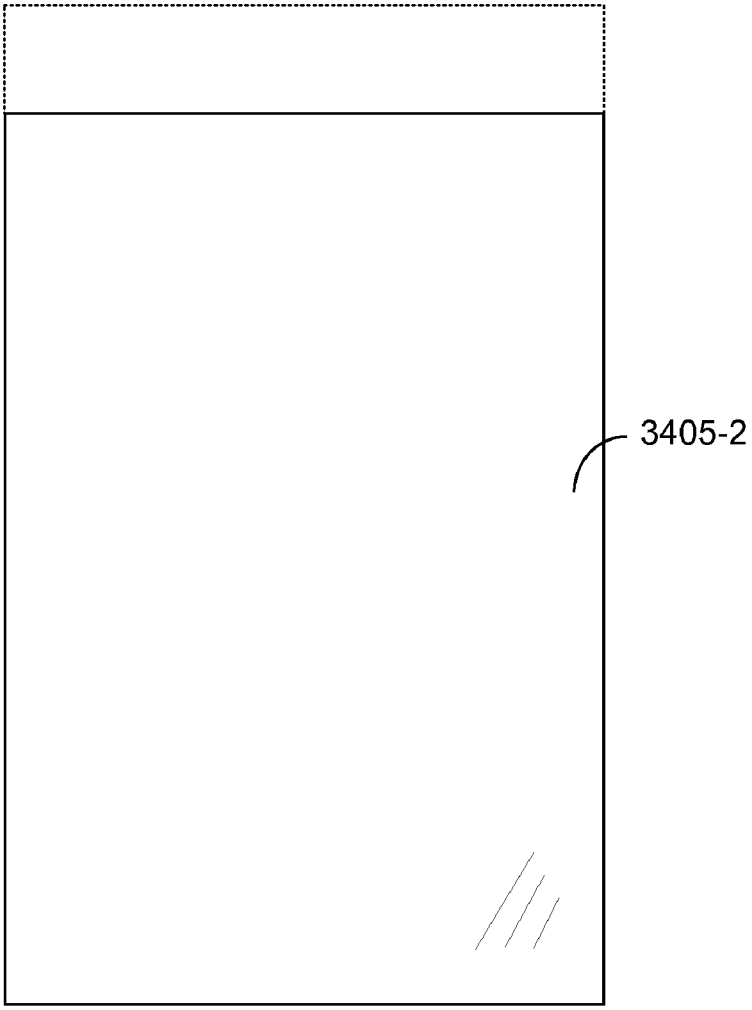
Figure 34C:
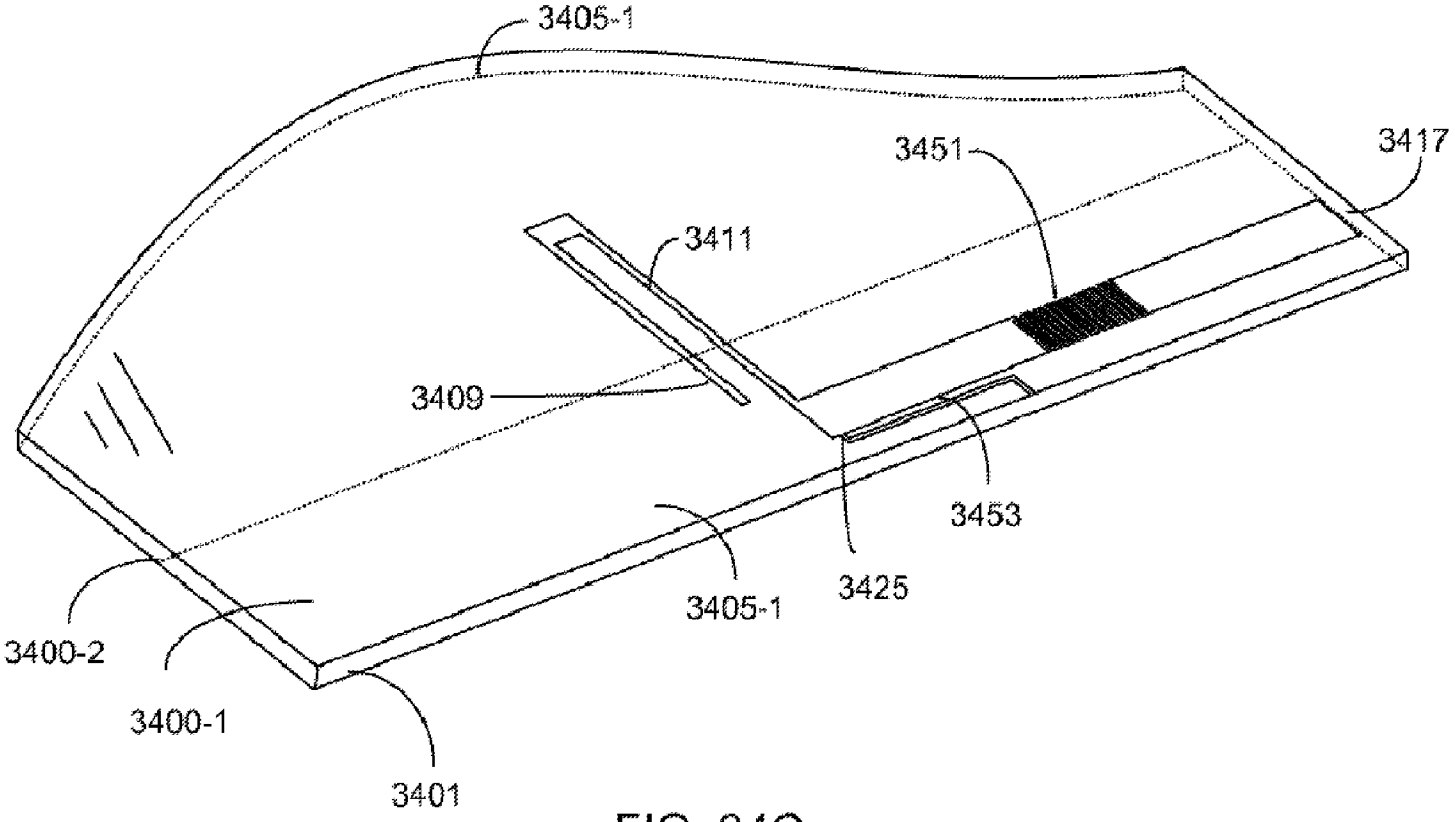

Other modified structures controlling C1 and C2 may include the use of interdigital capacitors and other coupling gap configurations. Interdigital capacitors include, for example, two sets of interlaced conductive metal fingers, printed or patterned on a conductive layer or on different conductive layers. For example, FIGS. 34A-34C illustrate a modified version of the MTM-B1 slot antenna device 2900, which is referred to herein as MTM-B2 slot antenna device 3400. FIGS. 34A-34C respectively illustrate a top view of a top layer 3400-1, a top view of a bottom layer 3400-2, and an isometric view of a slot antenna device 3400, according to an example embodiment. In both form and function, the MTM-B2 slot antenna device 3400 is fundamentally similar to that of the MTM-B1 slot antenna device 2900, except that the conductive strip 2951 and the second lumped capacitor 2953 are replaced with an interdigital capacitor $C_2$ 3451, and the coupling gap 2925 and lumped capacitor 2929 are replaced by an extended coupling gap $C_L$ 3453, which increases the size or shape of the coupling gap 2925. By controlling the dimensions of the interdigital capacitor $C_2$ 3451 and the extended coupling gap 3453, similar antenna operational frequencies and efficiency results can be obtained as the ones shown in FIGS. 31-33.

Since the size, shape and structure of the MTM-B2 slot antenna device 3400 are fundamentally similar to the previous slot antenna device 2900, several design parameters and features of the previous antenna device 2900 may directly apply to the MTM-B2 slot antenna device 3400. A full description of these design parameters are provided in the previous example.

In FIG. 34C, an isometric view of the MTM-B2 slot antenna device 3400 is presented and illustrates the stacking orientation of the top conductive layer 3400-1, substrate 3401, and bottom conductive layer 3400-2. Various elements presented in FIGS. 34A-34B, such as the slot, CPW feed and ground of the top and bottom layers, are presented in the isometric view shown in FIG. 34C.

The MTM-B2 slot antenna device 3400 may be activated by connecting an RF source to the CPW feed port 3413 and the antenna ground 3405 to excite the MTM-B2 slot antenna 3400. The CRLH parameters for the MTM-B2 slot antenna 3400 may include a series inductor $L_R$ and a shunt capacitor $C_R$ corresponding to the inductance and the capacitance defined by conductive sections forming the antenna slot section 3403, the connecting slot section 3404, and the CPW slot section 3407. The shunt capacitance may include capacitors ($C_R$ and $C_2$) where $C_R$ is generated by the upper side and lower side conductive plates 3408 and 3410 of the right and left antenna slots 3403-1 and 3403-2, and $C_2$ is attributed to the interdigital capacitor 3451. In addition, the CRLH parameters for the MTM-B2 slot antenna 3400 may also include a shunt inductor $L_L$, as induced by the additional current flow at the left closed end 3417 of the antenna slot 3403, and series capacitors ($C_L$ and $C_1$), where $C_L$ is generated by the coupling gap 3425 and $C_1$ is determined by the extended coupling gap 3453. In this example, as in the previous one, the series capacitance ($C_L+C_1$) and shunt inductance ($L_L$) represent the LH portion of the unit cell, and the shunt capacitance ($C_R+C_2$) and series inductance ($L_R$) represent the RH portion of the unit cell. Thus, the LH and RH resonances may be controlled by modifying certain attributes, such as the shape and size, affecting the capacitance of the extended coupling gap 3453 and the interdigital capacitor 3451, respectively.

These antenna structures can generate multiple resonances and can be fabricated by using printing techniques on a single or multi-layer PCB. Furthermore, the MTM antenna structures described herein may cover multiple disconnected and connected bands such as dual-band and multi-band operations.

While this specification contains many specifics, these should not be construed as limitations on the scope of any invention or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above are acting in certain combinations and even initially claimed as such, one or more features from a claimed combination can in some cases be exercised from the combination, and the claimed combination may be directed to a subcombination or variation of a subcombination.

Thus, particular embodiments have been described. Variations, enhancements and other embodiments can be made based on what is described and illustrated.

What is claimed is:

1. An antenna device, comprising:

a substrate having a first surface and a second surface;

a first conductive layer formed on the first surface of the substrate, the first conductive layer defining a plurality of adjoining openings comprising a contiguous slot that is rectilinear in shape and that abuts a coupling gap, a closed end of the slot being adjacent to an antenna feed, the first conductive layer including a top ground and a separated metal plate region that is rectilinear in shape, the metal plate region oriented parallel to an edge of the top ground defining the slot, the metal plate including an edge defining a portion of the slot opposite the parallel edge of the top ground, the coupling gap formed in the top ground and providing a separation between the top ground and the separated metal plate region; and a second conductive layer formed on the second surface of the substrate, the second conductive layer including a bottom ground;

wherein the first conductive layer defines the contiguous slot, the coupling gap, and the substrate to form a composite right and left handed (CRLH) metamaterial structure.

2. The antenna device as in claim 1, wherein the bottom ground is coupled to the portion of the top ground.

3. The antenna device as in claim 1 further comprising a plurality of conductive edges defined by the slot.

4. The antenna device as in claim 3 further comprising a conductive element coupled to the antenna slot, wherein the conductive element provides an electromagnetic signal to a plurality of conductive edges.

5. The antenna device as in claim 4, wherein the conductive element includes a coplanar wave (CPW) feed for transmitting or receiving electromagnetic waves.

6. The antenna device as in claim 1, wherein the slot includes an antenna slot, a connecting slot, a CPW slot, or a matching slot formed in the first conductive layer.

7. The antenna device as in claim 1, wherein the coupling gap includes an extended coupling gap.

8. The antenna device as in claim 1 further comprising a lumped capacitor coupled across the coupling gap between a top ground of the first conductive layer and the separated metal plate region.

9. The antenna device as in claim 1, wherein the slot is separated into two slot sections by an interdigital capacitor.

10. The antenna device as in claim 9, wherein a first capacitance provided by the interdigital capacitor, or by a lumped capacitor located between a portion of the conductive strip and the separated metal plate region, defines at least in part a right handed (RH) resonance frequency.

11. The antenna device as in claim 1, wherein a capacitance provided by the coupling gap or a lumped capacitor coupled across the coupling gap defines at least in part a left handed (LH) resonance frequency.

12. The antenna device as in claim 1, wherein the CRLH metamaterial structure supports dual-band or multiband frequencies.

13. The antenna device as in claim 1, wherein the slot is in the shape of a rectangle, triangle, circle or other polygon or non-linear shape.

14. An antenna device as in claim 1, wherein the CRLH metamaterial structure forms a slot antenna, and wherein the antenna device future comprises:

a series capacitance; and a shunt inductor, wherein the slot antenna is loaded by the series capacitance and the shunt inductor to form a CRLH antenna and excite a lower-frequency resonance as compared to the antenna device lacking the series capacitance and the shunt inductor.

15. The antenna device as in claim 14, wherein the first conductive layer, the series capacitance, and the shunt inductor are located on a single layer of the dielectric substrate.

16. The antenna device as in claim 14, wherein the series capacitance or the shunt inductor are discrete RF components.

17. The antenna device as in claim 14, wherein the slot antenna, the series capacitance, and the shunt inductor form a three dimensional structure.

18. The antenna device as in claim 1, wherein the CRLH metamaterial structure forms a slot antenna, and wherein the antenna device further comprises:

a plurality of series capacitance; and a plurality of shunt inductors, wherein the slot antenna is loaded by the series capacitances and the shunt inductors to form a CRLH antenna and excite a plurality of low, mid, or high frequency resonances.

19. The antenna device as in claim 18, wherein the first conductive layer, the plurality of series capacitances, and the plurality of shunt inductors are located on a single layer of dielectric substrate.

20. The antenna device as in claim 18, wherein the plurality of series capacitances or the plurality of shunt inductors are discrete RF components.

21. The antenna device as in claim 18, wherein the slot antenna, series capacitance, and shunt inductor form a three dimensional structure.

22. The antenna device of claim 1, wherein at least a portion of the slot is located on a portion of the first surface of the substrate that is projected above a cleared-out region of the bottom ground on the second surface of the substrate.

23. A method, comprising:

forming a substrate having a first surface and a second surface;

forming a first conductive layer on a first surface of the substrate, the first conductive layer defining a plurality of adjoining openings comprising a contiguous slot that is rectilinear in shape and that abuts a coupling gap, a closed end of the slot being adjacent to an antenna feed, the first conductive layer including a top ground and a separated metal plate region that is rectilinear in shape, the metal plate region oriented parallel to an edge of the top ground defining the slot, the metal plate including an edge defining a portion of the slot opposite the parallel edge of the top ground, the coupling gap formed in the top ground and providing a separation between the top ground and the separated metal plate region; and forming a second conductive layer on a second surface of the substrate, the second conductive layer including a bottom ground; wherein the contiguous slot, the coupling gap, the first conductive layer, and the substrate form a composite right and left handed (CRLH) metamaterial structure.

24. The method of claim 23, wherein at least a portion of the slot is located on a portion of the first surface of the substrate that is projected above a cleared-out region of the bottom ground on the second surface of the substrate.

25. The method of claim 23, further comprising providing a lumped capacitor coupled across the coupling gap between a top ground of the first conductive layer and the separated metal plate region.

26. The method of claim 23, wherein a capacitance provided by the coupling gap or by a lumped capacitor coupled across the coupling gap between a top ground of the first conductive layer and the separated metal plate region defines an LH resonance frequency at least in part.

27. The method of claim 23, wherein the slot is separated into two slot sections by an interdigital capacitor.

28. The method of claim 27, wherein a first capacitance provided by the interdigital capacitor, or a lumped capacitor located between a portion of the conductive strip and the separated metal plate region, defines an RH resonance frequency at least in part.

* * * * *

UNITED STATES PATENT AND TRADEMARK OFFICE

CERTIFICATE OF CORRECTION

PATENT NO. : 9,246,228 B2
APPLICATION NO. : 12/723540
DATED : January 26, 2016
INVENTOR(S) : Lee et al.

It is certified that error appears in the above-identified patent and that said Letters Patent is hereby corrected as shown below:

In the claims,

In column 26, line 53, in Claim 2, delete "the" and insert --a--, therefor

In column 26, line 61, in Claim 5, delete "wave" and insert --waveguide--, therefor In column 27, line 22, in Claim 14, delete "An" and insert --The--, therefor In column 27, line 24, in Claim 14, delete "future" and insert --further--, therefor Signed and Sealed this
Ninth Day of August, 2016

Michelle K. Lee

Michelle K. Lee
*Director of the United States Patent and Trademark Office*